US007866379B2

(12) United States Patent
Murayama et al.

(10) Patent No.: US 7,866,379 B2
(45) Date of Patent: Jan. 11, 2011

(54) HEAT EXCHANGER

(75) Inventors: Takuya Murayama, Aichi (JP); Hiroshi Shibata, Aichi (JP)

(73) Assignee: Panasonic Corporation, Osaka (JP)

( * ) Notice: Subject to any disclaimer, the term of this patent is extended or adjusted under 35 U.S.C. 154(b) by 1031 days.

(21) Appl. No.: 11/572,126

(22) PCT Filed: Jul. 16, 2004

(86) PCT No.: PCT/JP2004/010534

§ 371 (c)(1),
(2), (4) Date: Jan. 15, 2007

(87) PCT Pub. No.: WO2006/008823

PCT Pub. Date: Jan. 26, 2006

(65) Prior Publication Data

US 2007/0221366 A1 Sep. 27, 2007

(51) Int. Cl.
*F28F 3/08* (2006.01)

(52) U.S. Cl. ..... 165/166; 165/170

(58) Field of Classification Search ..... 165/166, 165/167, 170, 146, DIG. 916, 356, 365
See application file for complete search history.

(56) References Cited

U.S. PATENT DOCUMENTS

| | | | | |
|---|---|---|---|---|
| 6,059,025 | A * | 5/2000 | Hossfeld | 165/166 |
| 7,258,162 | B2 * | 8/2007 | Shibata et al. | 165/166 |
| 2006/0196649 | A1 * | 9/2006 | Shibata et al. | 165/166 |
| 2010/0071887 | A1 * | 3/2010 | Sugiyama et al. | 165/166 |

FOREIGN PATENT DOCUMENTS

| | | | |
|---|---|---|---|
| JP | 1972-19990 | | 6/1972 |
| JP | 56-71794 | A | 6/1981 |
| JP | 56-89585 | | 7/1981 |
| JP | 1981-89585 | U | 7/1981 |
| JP | 1983-154385 | U | 10/1983 |
| JP | 3-113292 | A | 5/1991 |
| JP | 1972-19990 | | 5/1991 |
| JP | 05-295051 | | 11/1993 |
| JP | 08-042988 | | 2/1996 |
| JP | 08-128794 | | 5/1996 |
| JP | 8-178577 | A | 7/1996 |
| JP | 08-291990 | | 11/1996 |
| JP | 9-241454 | A | 9/1997 |
| JP | 11-037675 | | 2/1999 |
| JP | 2002-286391 | A | 10/2002 |
| JP | 2003-246871 | A | 9/2003 |

OTHER PUBLICATIONS

International Search Report for PCT/JP2004/010534, dated Nov. 2, 2004.

* cited by examiner

*Primary Examiner*—Teresa J Walberg
(74) *Attorney, Agent, or Firm*—RatnerPrestia

(57) ABSTRACT

A heat exchanger with reduced pressure loss, and improved productivity and strength. The heat exchanger is made by laminating first heat conduction plates and second heat conduction plates alternately. A first heat conduction plate and a second heat conduction plate are integrally molded of one sheet. The sheet includes air duct ribs, heat conduction planes, air duct end faces, first protrusions, first outer peripheral ribs, second outer peripheral ribs, air duct end covers, and second protrusions.

18 Claims, 20 Drawing Sheets

HEAT EXCHANGER

This application is a U.S. National Phase Application of PCT International Application PCT/JP2004/010534.

TECHNICAL FIELD

The present invention relates to a heat exchanger for use in a heat exchange ventilator or air conditioner.

BACKGROUND ART

Recent years, heat exchanger type ventilating fans effective in saving energy have been popular. A heat exchanger for exchanging heat between indoor and outdoor air can save energy in an air conditioning device by recovering heat lost during ventilation of indoor air. An example of a counter flow system heat exchanger is disclosed in Unexamined Japanese Utility Model Publication No. 1981-89585.

Hereinafter, a description is provided of the conventional heat exchanger with reference to FIGS. 30 through 32.

As shown in FIG. 30, L-shaped spacers 102, each protruding so that the backside thereof is recessed to have a substantially V-shaped section, are formed on the surface of heat conduction plate 101 made of a plastic material, such as a rigid vinyl sheet.

A plurality of spacers 102 are spaced with each other to form heat conduction plane 103. The periphery of heat conduction plate 101 forms bent edges 104 that open slightly outward of the plane perpendicular to the plate.

At both ends of spacers 102 and along the outside halves of bent edges 104*a* and 104*b* facing the ends, slots 105*a* and 105*b* are provided as air inlets and outlets, respectively. Additionally, along the inside halves of the other bent edges 104*c* and 104*d*, slots 105*c* and 105*d* are provided as the air inlets and outlets symmetrically with slots 105*a* and 105*b* formed along the outside halves, respectively.

Then, laminating a plurality of heat conduction plates 101 so as to be positioned in orientations 180 degrees different from each other in one plane provides heat exchanger 106 as shown in FIG. 31.

As shown in FIG. 32, spacers 102 on heat conduction plate 101 and spacers 102 on adjacent heat conduction plate 101 are positioned parallel but misaligned to each other so as not to overlap. In this manner, the apexes of spacers 102 on a heat conduction plate are in contact with the top surface of heat conduction plane 103 of the adjacent heat conduction plate, and the outside half of bent edge 104 overlaps the inside half of adjacent bent edge 104. Thus, two kinds of air channels 107*a* and 107*b* divided into a plurality of L-shaped air ducts by spacers 102 are alternately formed between these heat conduction plates 101. At one end of each channel, slots 105*a* or 105*c* in the bent edges form inlets. At the other end of each channel, slots 105*b* or 105*d* in the bent edges form outlets, in the similar manner.

The arrows in FIG. 32 show fluid flows.

In the above conventional heat exchanger, no air flows through the portion of spacer 102 having substantially a V-shaped section. For this reason, in the portion in which apex W of spacer 102 is in contact with heat conduction plane 103 of heat conduction plate 101, no heat is exchanged. Reducing the area of apex W by substantially V-shaping the section of spacer 102 intends to reduce the area in which no heat is exchanged. However, spacers 102 on heat conduction plate 101 and spacers 102 on adjacent heat conduction plate 101 are positioned parallel but misaligned to each other not to overlap, and apexes W of spacers 102 are in contact with the top surface of heat conduction plane 103 on the adjacent heat conduction plate. This structure doubles the portion of no heat exchange on heat conduction plate 101 and heat conduction plate 101 under the former plate.

As a result, this structure poses a problem that reduction in effective heat transfer area deteriorates heat exchange efficiency. Thus, increases in the heat transfer efficiency are required.

Additionally, in heat exchanger 106 obtained by laminating a plurality of heat conduction plates 101 in orientations 180 degrees different from each other in one plane, only spacers 102 support the spacing between heat conduction plates 101.

For this reason, weight of the plurality of laminated heat conduction plates 101 or external force exerted thereon can deform spacers 102 and air channels 107*a* and 107*b* can collapse. This poses a problem of decreasing the opening areas of the channels and increasing pressure loss. Thus, improvement of strength and reduction in pressure loss are required.

Heat conduction plate 101 is obtained by vacuum-molding a plastic material, such as a rigid vinyl sheet, and cutting five portions, i.e. the outer periphery of bent edges 104 and slots 105*a*, 105*b*, 105*c*, and 105*d* in the bent edges. At this time, it is difficult to cut out the outer periphery of bent edges 104 in a vertical direction and four slots in the bent edges in a horizontal direction by one step. This poses a problem of low production efficiency, and thus improvement thereof is required.

In the outer peripheries near the inlets and outlets of heat exchanger 106, because bent edges 104 of heat conduction plate 101 are in contact with spacers 102 on another heat conduction plate 101 laminated thereon, spacers 102 prevent bent edges 104 from being deformed by lateral external force. Thus, air-tightness is unlikely to be deteriorated by deformation of bent edges 104.

However, the outer peripheries in the portions other than the inlets or outlets in heat exchanger 106 only has contact of bent edges 104 of heat conduction plate 101 with bent edges 104 of another heat conduction plate 101 laminated thereon. Thus, bent edges 104 are likely to be deformed by lateral external force. This poses a problem that deformation of bent edges 104 deteriorates air-tightness. Thus, improvement of strength and a highly air-tight structure are required.

The present invention aims to address these conventional problems, and provides a heat exchanger having improved basic performance, such as increasing heat exchange efficiency and decreasing pressure loss, as well as improved productivity and strength.

SUMMARY OF THE INVENTION

The present invention provides a heat exchanger including first heat conduction plates and second heat conduction plates, each in substantially a square shape. Each of the first and second heat conduction plates includes: a plurality of substantially L-shaped air duct ribs forming a plurality of substantially L-shaped air ducts and heat conduction planes; outer peripheral ribs for shielding leak of fluid flowing through the air ducts to the outside of the heat conduction plate; and an air-tightness ensuring means. The first heat conduction plate and the second heat conduction plate are integrally molded of one sheet material. The first heat conduction plates and the second heat conduction plates are alternately laminated on top of each other.

DETAILED DESCRIPTION OF PREFERRED EMBODIMENTS

Hereinafter, exemplary embodiments of the present invention are detailed with reference to the accompanying drawings. The drawings are schematic and do not show the correct dimensions of the positions. In the respective exemplary embodiments, same elements are denoted with the same reference marks, and the detailed descriptions thereof are omitted.

In each of the exemplary embodiments, only four heat conduction plates are shown for simplicity. However, actually, a plurality of first and second heat conduction plates are laminated alternately.

First Exemplary Embodiment

Figure 1:
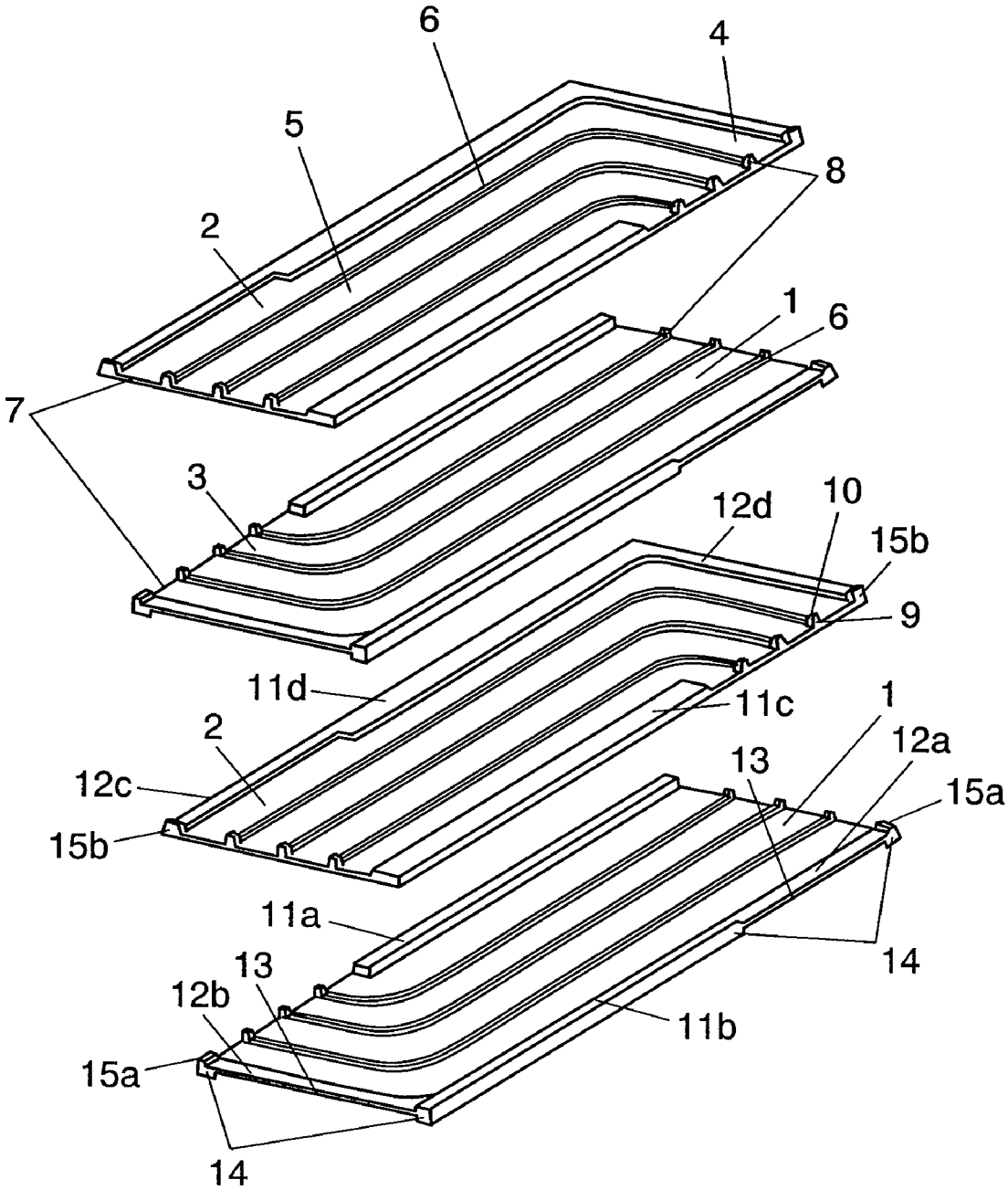
FIG. 1 is an exploded view in perspective of a heat exchanger in accordance with a first exemplary embodiment of the present invention.
Figure 2:
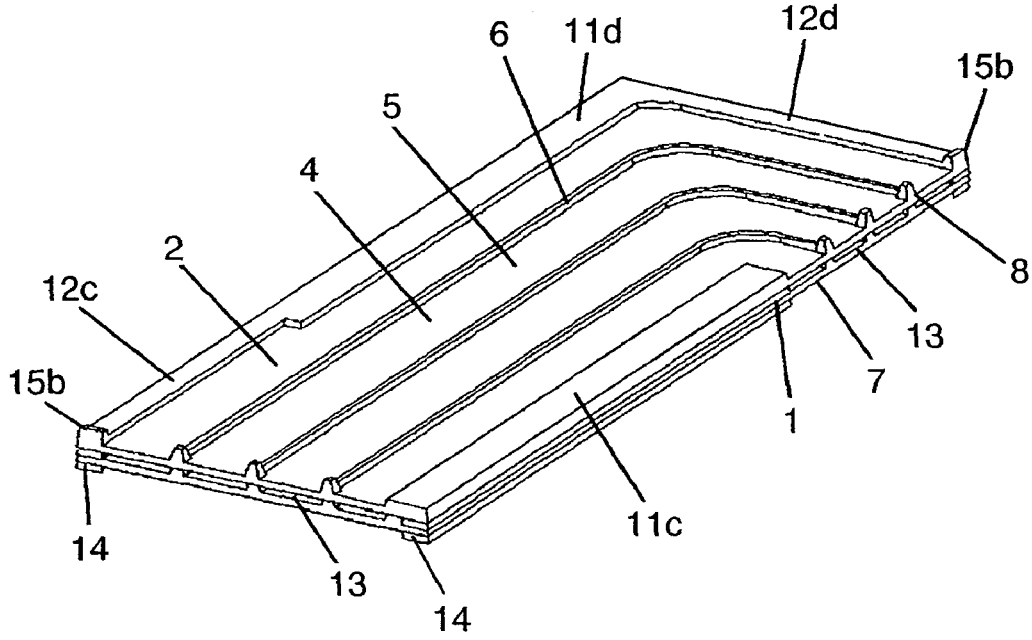
FIG. 2 is a perspective view of the heat exchanger in accordance with the first exemplary embodiment in a laminated state.
Figure 3:
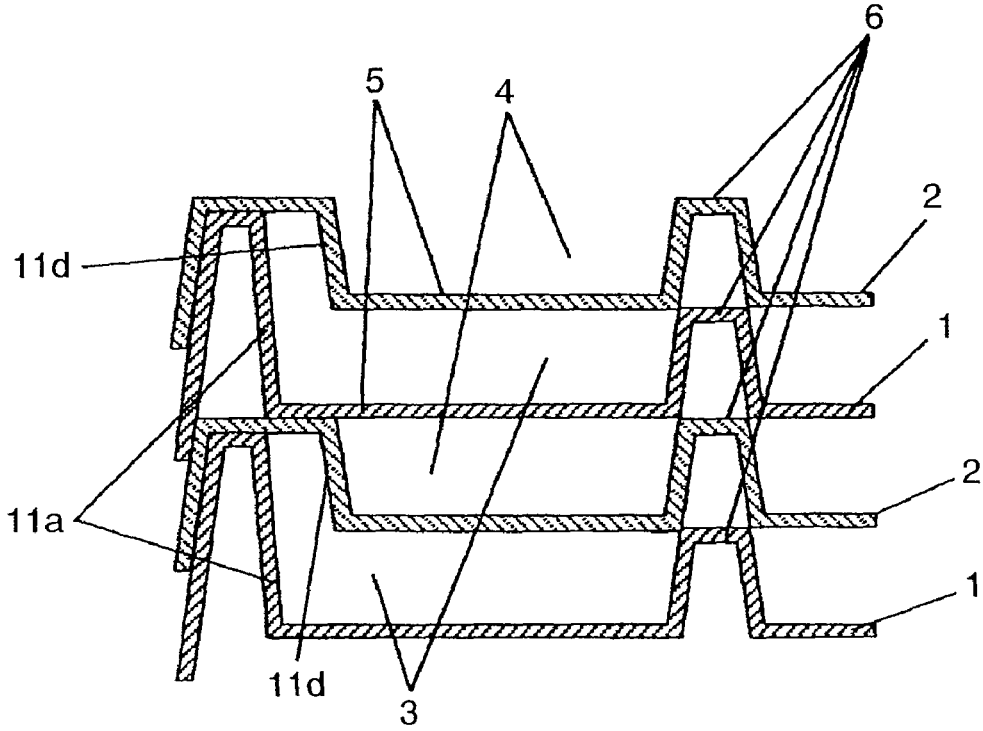
FIG. 3 is a section of a side portion of the heat exchanger in accordance with the first exemplary embodiment in the laminated state.

With reference to FIGS. 1 to 3, the first exemplary embodiment is described.

As shown in FIGS. 1 and 2, a counter-flow type heat exchanger is made by laminating first heat conduction plates 1 and second heat conduction plates 2 alternately.

Then, first air ducts 3 and second air ducts 4 are formed over and under the respective heat conduction plates. Fluids flowing through first ducts 3 exchange heat via the respective heat conduction plates. The fluids flow in the orthogonal direction with each other at the respective inlets and outlets of the air ducts, and in the facing direction with each other in the central portions of the air ducts.

Each of first heat conduction plates 1 and second heat conduction plates 2 is made by vacuum-molding a polystyrene sheet having a square plane shape and a thickness of 0.2 mm, for example. First heat conduction plate 1 includes three substantially L-shaped air duct ribs 6 at an equal spacing in parallel with each other. Each of the ribs is a hollow protrusion 2 mm high and 2 mm wide, for example, formed on heat conduction plane 5.

Air duct ribs 6 form substantially L-shaped first air ducts 3 and heat conduction planes 5. Along each of the inlet and outlet of first air ducts 3, air duct end face 7 is provided. The air duct end face is made by bending the edge of first heat conduction plate 1 in a direction opposite to the protruding direction of air ducts 6 to a position 2.2 mm, for example, from heat conduction plane 5. Then, at each of both ends of air duct ribs 6, a plurality of first protrusions 8 are provided in six positions, for example. Each of the first protrusions is hollow in the protruding direction of air duct ribs 6 and higher than the air duct ribs, e.g. 4 mm high from heat conduction plane 5.

Each of first protrusions 8 includes side surface 9 parallel to air duct end face 7, and top surface 10 parallel to heat conduction plane 5. Along the outer peripheries of first heat conduction plate 1 other than the inlets and outlets of first air ducts 3 and substantially parallel to the air duct portions sandwiched between the inlets and outlets thereof to provide counter flows, first outer peripheral rib 11*a* is provided. The first outer peripheral rib is a hollow protrusion in the protruding direction of air duct ribs 6 having a height equal to that of first protrusions 8, and a width of 4 mm, for example. Provided diagonally of first peripheral rib 11*a* is first outer peripheral rib 11*b* shaped identical thereto. The top surface of each of first outer peripheral ribs 11 is parallel to heat conduction plane 5, and the outer side surface thereof is bent to the same position as air duct end face 7. Provided along the outer peripheries of first heat conduction plate 1 other than the inlets and outlets of first air ducts 3 and first outer peripheral ribs 11 are second outer peripheral ribs 12(*a* and *b*) shaped identical to each other.

Now expression 12(*a* and *b*) in the present invention is described. Expression 12 indicates both 12*a* and 12*b*. Among the other cases, expression 11(*c* and *d*), for example, indicates both 11*c* and 11*d*. Second outer peripheral rib 12*a* is substantially parallel to first outer peripheral ribs 11. Second outer peripheral rib 12*b* is substantially orthogonal to first outer peripheral ribs 11. Each of the second outer peripheral ribs is a hollow protrusion in the protruding direction of air duct ribs 6 having a height equal to that of air duct ribs 6, and width of 7 mm, for example.

The top surface of each of second outer peripheral ribs 12 is parallel to heat conduction plane 5. The central portion of the outer side surface of each second outer peripheral rib is bent to the position of heat conduction plane 5 to form air duct slot 13. Further, each of the ends of each second outer peripheral rib is bent to the position of air duct end face 7 in a portion of 5 mm, for example, from the corner, to form air duct end face cover 14.

On the side of air duct end face 7, each of second outer peripheral ribs 12 has second protrusion 15*a* formed as a hollow protrusion in the protruding direction of air duct ribs 6 having a height equal to that of first protrusion 8 and a width of 3 mm, for example.

Second protrusions 15*a* are substantially orthogonal to second protrusions 15*b* provided on second heat conduction plate 2 positioned thereon.

The top surfaces of second protrusions 15*a* are in contact with the bottom surfaces of second outer peripheral ribs 12 on second heat conduction plate 2 positioned thereon.

Second heat conduction plate 2 is analogous to first heat conduction plate 1. In second heat transfer plate 2, each of first outer peripheral ribs 11(*c* and *d*) is as high as air duct ribs 6. Further, each of first outer peripheral ribs 11(*c* and *d*) on second heat conduction plate 2 is wider (e.g. 7 mm) than each of outer peripheral ribs 11(*a* and *b*) on first heat conduction plate 1.

The heat exchanger is formed as shown in FIG. 3 when first heat conduction plates 1 and second heat conduction plates 2 are alternately laminated. The top surfaces of first outer peripheral ribs 11(*a* and *b*) on the first heat conduction plates are in close contact with first outer peripheral ribs 11(*c* and *d*) on second heat conduction plates 2, respectively, laminated thereon. Further, the top surfaces of first outer peripheral ribs 11(*c* and *d*) on second heat conduction plates 2 are in close contact with first outer peripheral ribs 11(*a* and *b*) on first heat conduction plates 11, respectively, laminated thereon. The outer surfaces of the outer sides of first outer peripheral ribs 11 are in close contact with the inner surfaces of the inner sides of outer peripheral ribs 11 on the adjacent plates. In this manner, air ducts 3 and second air ducts 4 are tightly sealed along each of first outer peripheral ribs 11.

Along the outer peripheries of the heat exchanger, the spacing between air duct ribs 6 on a heat conduction plate and another heat conduction plate laminated thereon is kept by contact of the top surfaces of first outer peripheral ribs 11 on the heat conduction plate with the bottom surfaces of first outer peripheral ribs 11 on the other heat conduction plate laminated thereon, contact of the top surfaces of first protrusions 8 at the inlets and outlets of first air ducts 3 and second air ducts 4 with the bottom surfaces of second outer peripheral ribs 12 on the other heat conduction plate laminated thereon, and contact of the top surfaces of second protrusions 15 at end faces of second outer peripheral ribs 12 with the bottom surfaces of second outer peripheral ribs 12 on the other heat conduction plate laminated thereon.

Further, in a portion near the inlets and outlets of the heat exchanger where airflows are orthogonal to each other, the spacing is kept by contact of air duct ribs 6 with heat conduction planes 5 of the other heat conduction plate laminated thereon. Such contact can securely keep the height of first air ducts 3 and second air ducts 4.

This air duct height is designed according to performance, such as airflow resistance, and moldability of the heat exchanger.

In substantially central portions of the side surfaces of the heat exchanger, air duct ribs 6 on first heat conduction plates 1 and second heat conduction plates 2 are placed in vertically aligned positions.

When the airflows through first air ducts 3 and second air ducts 4 in the opposed direction exchange heat via heat conduction planes 5, no air flows through air duct ribs 6 formed by the heat transfer plates into substantially L-shaped hollow protrusions, and thus no heat is exchanged therein. Placing air duct ribs 6 on first heat conduction plates 1 and second heat conduction plates 2 in vertically aligned positions can minimize the area of no heat exchange within a certain volume.

Figure 4:
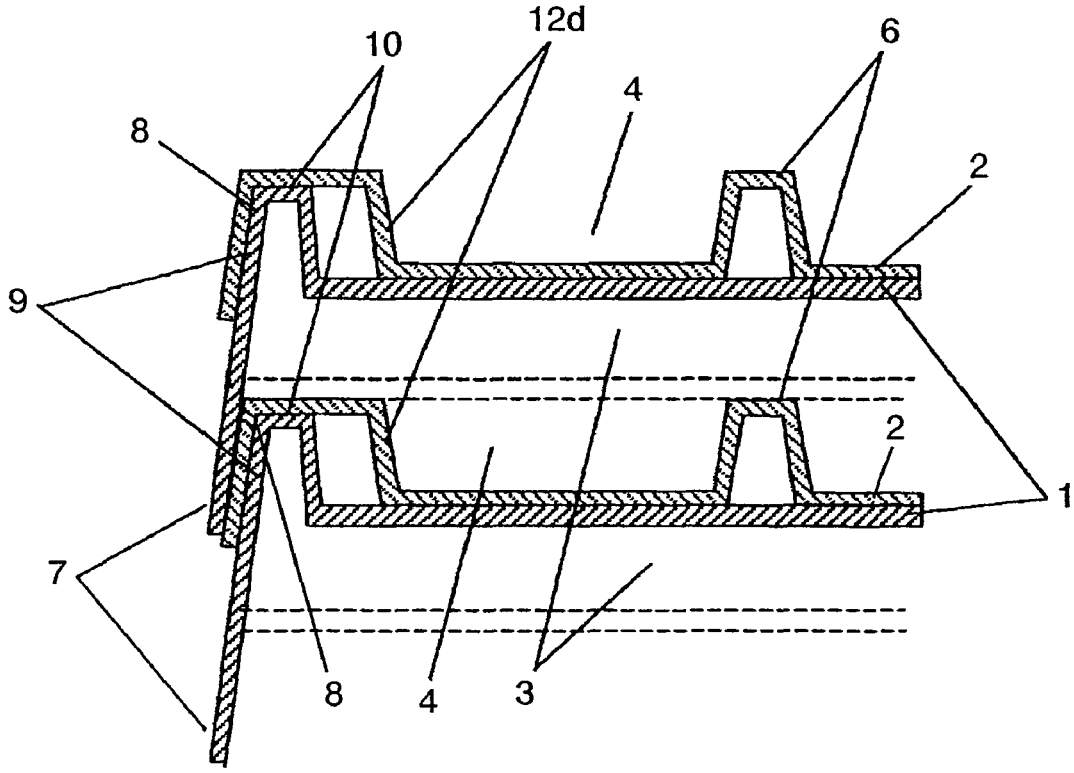
FIG. 4 is a section of an air duct inlet and outlet portion of the heat exchanger in accordance with the first exemplary embodiment in the laminated state.

As shown in FIG. 4, at the air duct inlets and outlets, the top surfaces of second outer peripheral ribs 12 are in close contact with the heat conduction plates laminated thereon. Then, side surfaces 9 of first protrusions 8 parallel to air duct end faces 7 are in close contact with the inner surfaces of the outer sides of second outer peripheral ribs 12 on the transfer plates laminated thereon.

Further, top surfaces 10 of first protrusions 8 are in close contact with the bottom surfaces of second outer peripheral ribs 12 on the heat transfer plates laminated thereon. The outer side surfaces of second outer peripheral ribs 12 are in close contact with the inner surfaces of air duct end faces 7 of the heat transfer plates laminated thereon. The components of the heat exchanger are formed in the above structure.

Such contact tightly seals first air ducts 3 and second air ducts 4 at the inlets and outlets thereof, prevents misalignment of laminated heat transfer plates, and positions the heat transfer plates during lamination.

Figure 5:
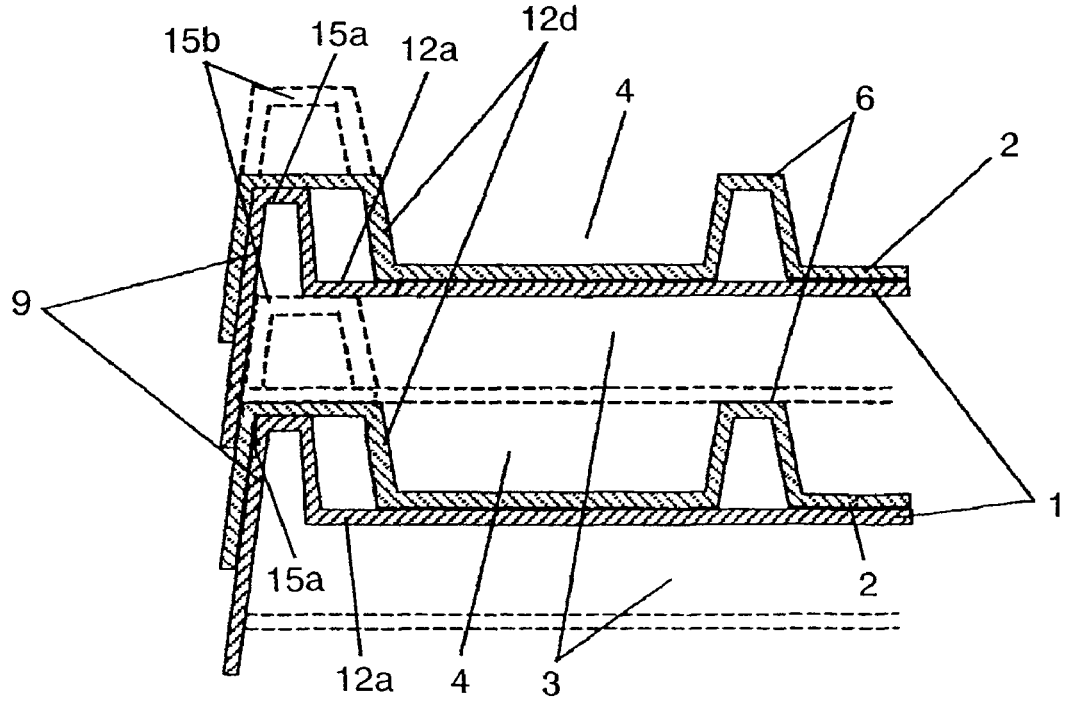
FIG. 5 is a section of a corner portion in which second peripheral ribs 12 on first heat conduction plate 1 and second heat conduction plate 2 in the laminated state intersect with each other in the heat exchanger in accordance with the first exemplary embodiment.

As shown in FIG. 5, at the corners where second outer peripheral ribs 12(*a* and *b*) on first heat conduction plates 1 intersect second outer peripheral ribs 12(*c* and *d*) on second heat conduction plates 2, the top surfaces of second protrusions 15*a* on the top surfaces of second outer peripheral ribs 12(*a* and *b*) are in contact with the bottom surfaces of second outer peripheral ribs 12(*c* and *d*) on second heat conduction plates 2 laminated thereon. Such contact inhibits deformation of the heat conduction plates in the laminated direction and prevents air-tightness from being deteriorated by the deformation.

Figure 6:
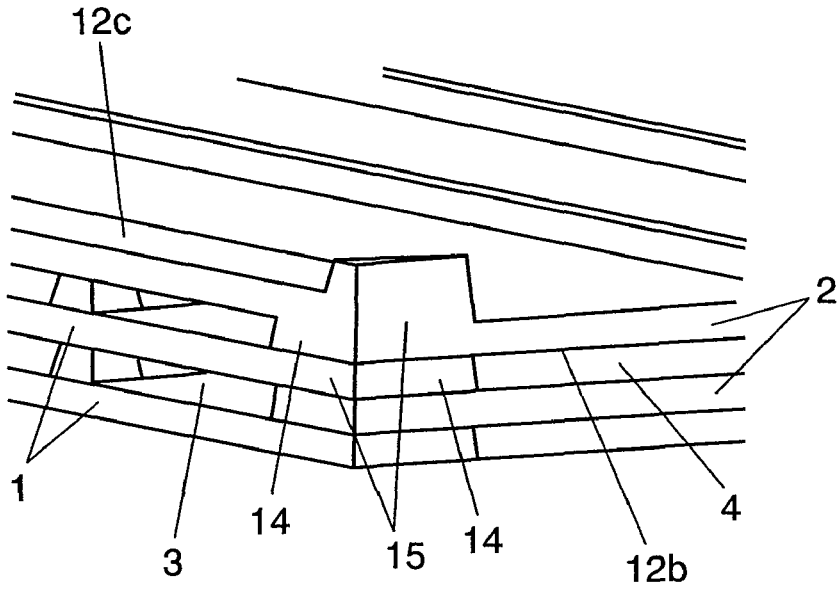
FIG. 6 is an enlarged view in perspective of a corner portion in which air duct inlets and outlets are adjacent to each other in the heat exchanger in accordance with the first exemplary embodiment in the laminated state.
Figure 7:
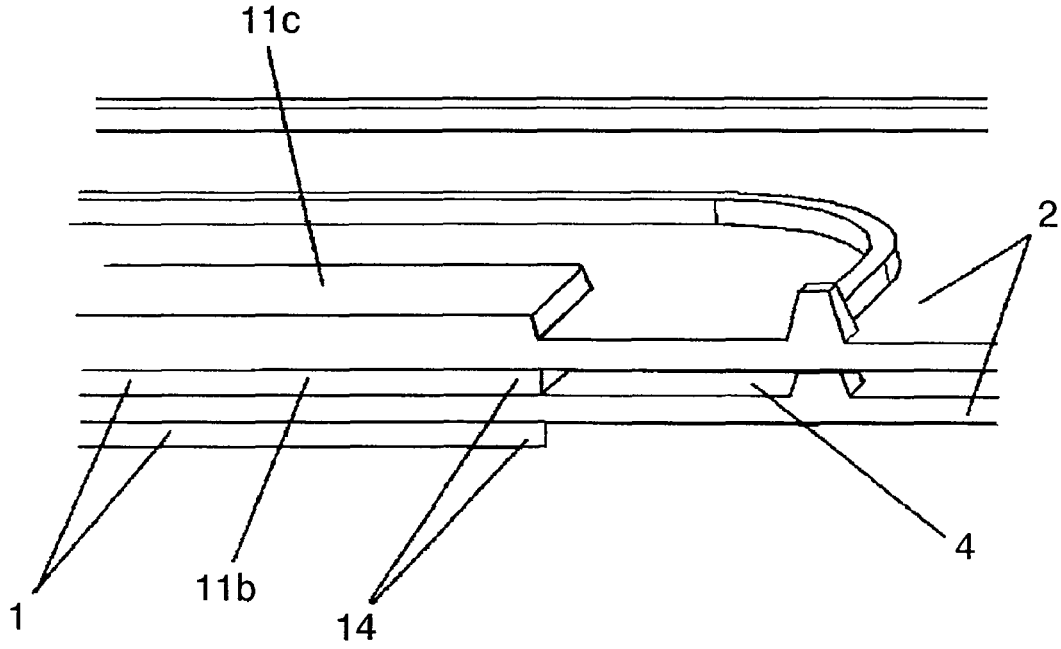
FIG. 7 is an enlarged view in perspective of a portion in which air duct inlets and outlets are adjacent to first outer peripheral ribs 11 in the heat exchanger in accordance with the first exemplary embodiment in the laminated state.

As shown in FIGS. 6 and 7, at both ends of the inlets and outlets of first air ducts 3 and second air ducts 4, at the corners where second outer peripheral ribs 12(*a* and *b*) on first heat conduction plates 1 intersect second outer peripheral ribs 12(*c* and *d*) on second heat conduction plates 2, the end faces of second protrusions 15 on second outer peripheral ribs 12 are in close contact with the inner surfaces of duct end face covers 14 on the heat conduction plates laminated thereon. In the portions where the inlets and outlets of first air ducts 3 or second air ducts 4 are adjacent to first outer peripheral ribs 11, the end faces of first outer peripheral ribs 11 are in close contact with the inner surfaces of air duct end face covers 14 on the heat conduction plates laminated thereon.

Such contact ensures the air-tightness at both ends of side surfaces of first air ducts 3 and second air ducts 4.

Figure 8:
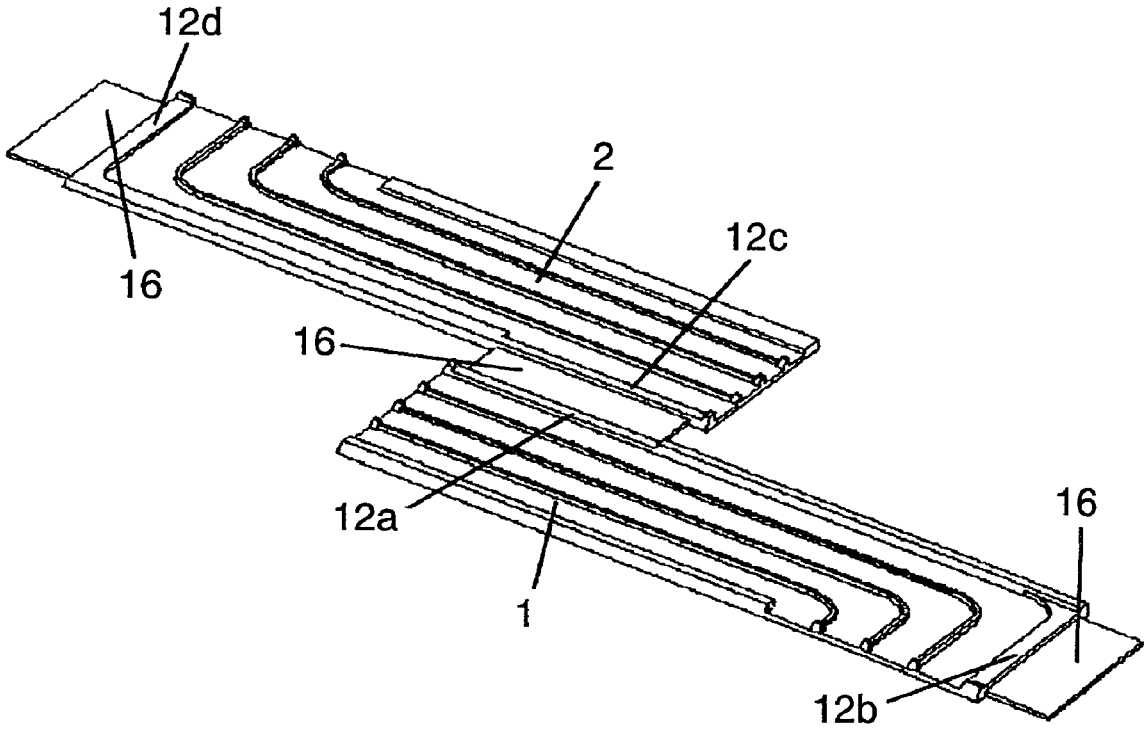
FIG. 8 is a perspective view illustrating a method of molding the heat conduction plates of the heat exchanger in accordance with the first exemplary embodiment.

As shown in FIG. 8, first heat conduction plate 1 and second heat conduction plate 2 are integrally molded, using a molding die that has square parts continuing to the outer side surfaces of second outer peripheral ribs 12 and having a sectional shape identical to that of the slots formed in the outer side surfaces of second outer peripheral ribs 12.

After molding, the part other than slot-forming portions 16 made of the square parts is cut out at a time using a Thompson type die or the like, along the outer side surfaces of first heat conduction plate 1 and second heat conduction plate 2. Thus, molded sheets of first heat conduction plate 1 and second heat conduction plate 2 are obtained.

The above structure can enhance the air-tightness of the inlets and outlets of first air ducts 3 and second air ducts 4 and along side surfaces of a heat exchanger, and thus the air-tightness of the entire heat exchanger.

Air duct ribs 6 substantially parallel to first outer peripheral ribs 11 on first heat conduction plates 1 and second heat conduction plates 2 are in vertically aligned positions. As a result, when heat is exchanged by airflows through first air ducts 3 and second air ducts 4 formed by alternately laminating first heat conduction plates 1 and second heat conduction plates 2, no heat is exchanged in air duct ribs 6 formed into substantially L-shaped hollow protrusions by the heat conduction plates. In this manner, placing air duct ribs 6 on first heat conduction plates 1 and second heat conduction plates 2 in vertically aligned positions can minimize the area of no heat exchange within a certain volume.

In other words, this structure can provide a larger effective heat transfer area and heat exchange effectiveness than a structure having vertically misaligned air duct ribs 6 on heat conduction plates.

Along the outer peripheries of the inlets and outlets of first air ducts 3 and second air ducts 4 of the heat exchanger, contact of second outer peripheral ribs 12 on the heat conduction plates with air duct end faces 7 on the heat conduction plates laminated thereon prevents the side surfaces from being deformed by external force lateral to the lamination direction.

This prevention is provided by the cross-linking effect of first protrusions 8 in communication with air duct end faces 7, and the plurality of substantially L-shaped air duct ribs 6.

Further, along the outer peripheries other than the inlets and outlets of first air ducts 3 and second air ducts 4, contact of the top and side surfaces of first outer peripheral ribs 11 formed into hollow protrusions by heat conduction planes 5 with the bottom and side surfaces of first outer peripheral ribs 11 on the heat transfer plates laminated thereon can improve the strength against lateral external force. This effect is larger than the effect of the side surfaces of a heat exchanger made by simply folding the outer peripheries of the heat conduction plates thereof.

The top surfaces of first outer peripheral ribs 11 on the heat conduction plates are in contact with the bottom surfaces of first outer peripheral ribs 11 on the heat conduction plates laminated thereon. The top surfaces of first protrusions 8 at the inlets and outlets of first air ducts 3 and second air ducts 4 are in contact with the bottom surfaces of second outer peripheral ribs 12 on the heat conduction plates laminated thereon. The top surfaces of second protrusions 15 at the end faces of second outer peripheral ribs 12 are in contact with the bottom surfaces of second outer peripheral ribs 12 on the heat conduction plates laminated thereon. Such contact can support the weight of the plurality of laminated plates and external force exerted from the top surface in the outer peripheries of the heat exchanger. In this manner, such contact can improve strength against external force in the lamination direction of the heat exchanger, and securely keep the height of one heat conduction plane 5 so that air duct ribs 6 do not collapse.

As a result, this structure can secure the opening area of first air ducts 3 and second air ducts 4, and thus reduce pressure loss.

First heat conduction plate 1 and second heat conduction plate 2 are formed, using a molding die that has square parts continuing to the outer side surfaces of second outer peripheral ribs 12 and having a sectional shape identical to that of the slots formed in the outer side surfaces of the second outer peripheral ribs. First heat conduction plate 1 and second heat conduction plate 2 can be cut at a time using a Thompson type die or the like, and thus the productivity can be improved.

In this exemplary embodiment, a polystyrene sheet is used as a material of the heat conduction plates, and the heat conduction plates are integrally formed by vacuum molding. The materials include film made of other thermoplastic resins, e.g. polypropylene and polyethylene, thin plate made of metal, e.g. aluminum, heat-conductive and moisture-permeable paper materials, micro-porous resin film, and paper materials containing resin mixed therein. The other methods of integrally forming the heat conduction plates using other techniques, such as air-pressure molding, very high pressure molding, and press molding, can also provide the similar advantages.

Resin containing rubber particles dispersed therein can also be used as a sheet material for the heat conduction plates. Specifically, styrene-based resin containing rubber particles dispersed therein, high impact polystyrene containing rubber particles dispersed therein, and acrylonitrile-butadiene-styrene (ABS) resin containing rubber particles dispersed therein can be used.

The styrene-based resin includes polystyrene.

In this exemplary embodiment, first heat conduction plates 1 and second heat conduction plates 2 are integrally formed by vacuum molding method. In the vacuum molding method, after a thermo-plastic resin sheet is heated and softened, the sheet is placed on a molding die having protrusions and depressions and stuck to the surface of the die using a vacuum pump.

Further, by dispersing rubber particles in the resin of the sheet material, the elasticity of the rubber can prevent cracks of first heat conduction plate 1 and second heat conduction plate 2 during vacuum molding. The use of such material can improve the impact resistance of a heat exchanger obtained by alternately laminating first heat conduction plates 1 and second heat conduction plates 2, and thus improve the strength thereof against cracks or impacts. Additionally, the use of such material can prevent deterioration of air-tightness caused by cracks of first heat conduction plates 1 and second heat conduction plates 2, and thus improve air-tightness.

In this exemplary embodiment, the thickness of the sheet is 0.2 mm, and the preferable thickness ranges from 0.05 to 0.5 mm (inclusive). This is because, at a thickness up to 0.05 mm, damage, such as breakage, is likely to occur while protrusions and depressions are molded and the heat conduction plates are handled after the molding. Further, the molded heat conduction plate is not strong and is difficult to handle with. In contrast, at a thickness exceeding 0.5 mm, the heat conductivity deteriorates.

Generally, sheets having the smaller thickness tend to have the higher heat conductivity and lower moldability. In contrast, those having the larger thickness tend to have the lower heat conductivity.

For the above reasons, preferably, the thickness of the sheet material ranges from 0.05 to 0.5 mm to provide satisfactory moldability and heat conductivity. Most preferably, the thickness thereof ranges from 0.15 to 0.25 mm (inclusive).

The dimension and the number of components shown in this embodiment are only an example. The present invention is not limited to these values. Heat exchangers appropriately designed according to performance, e.g. air flow resistance and heat exchange efficiency, and moldability thereof, can provide the similar advantages.

Second Exemplary Embodiment

Figure 9:
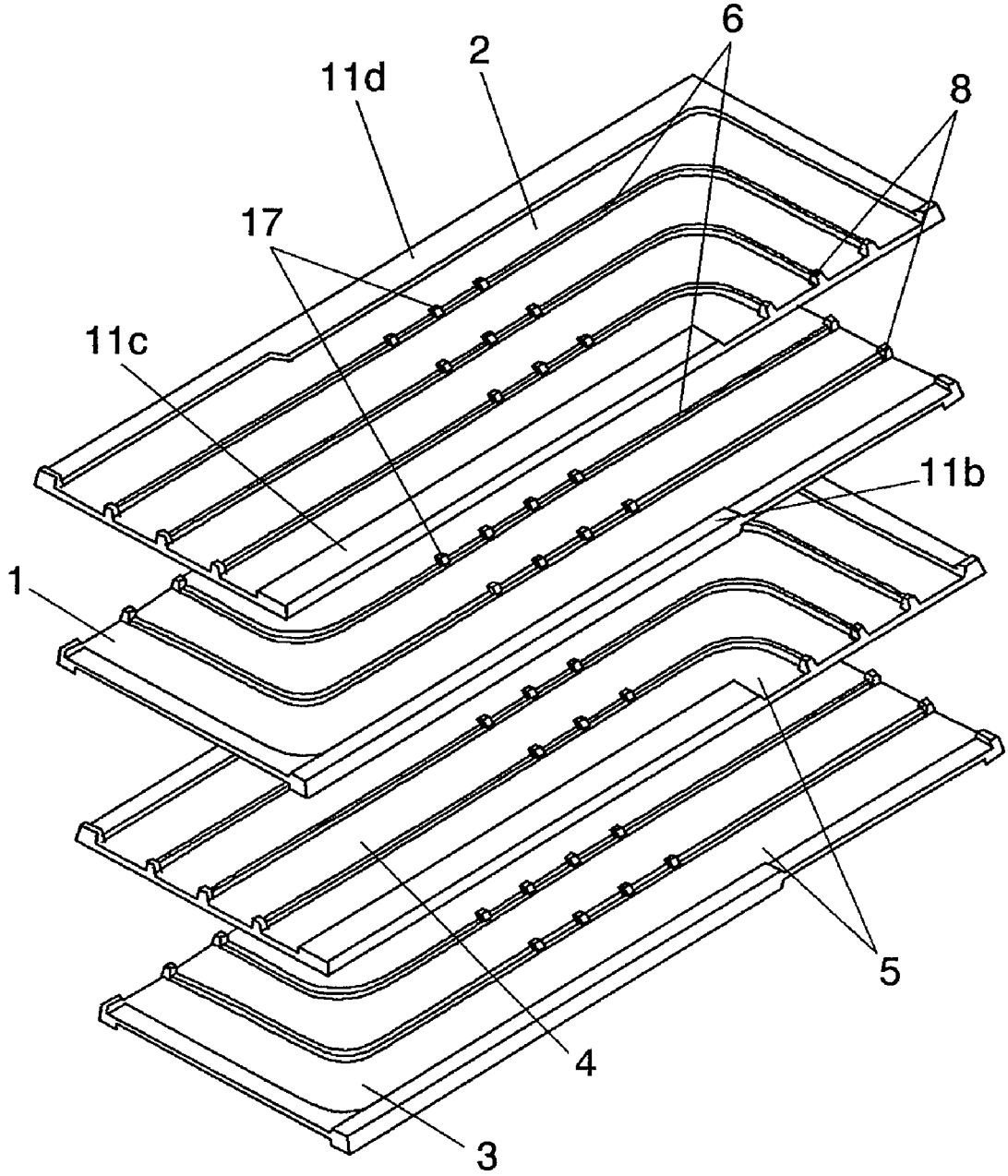
FIG. 9 is an exploded view in perspective of a heat exchanger in accordance with a second exemplary embodiment of the present invention.
Figure 10:
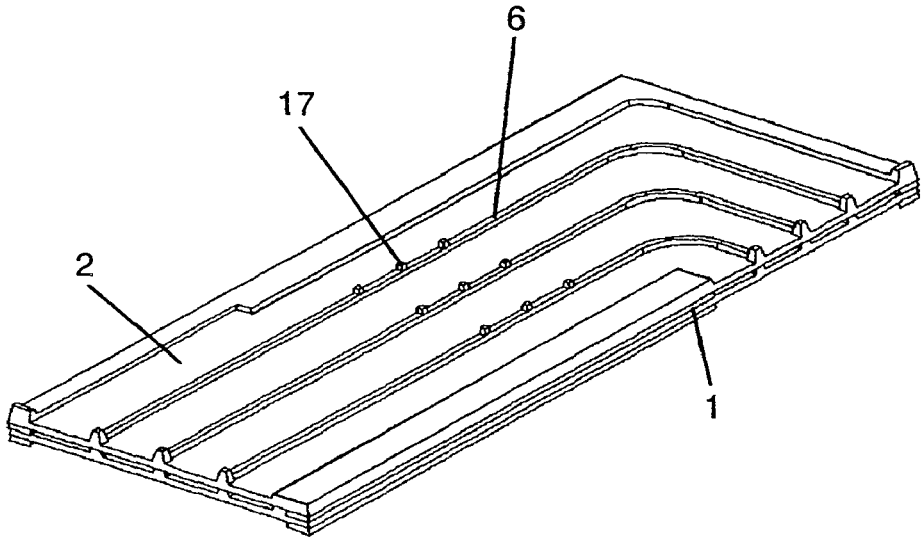
FIG. 10 is a perspective view of the heat exchanger in accordance with the second exemplary embodiment in a laminated state.
Figure 11:
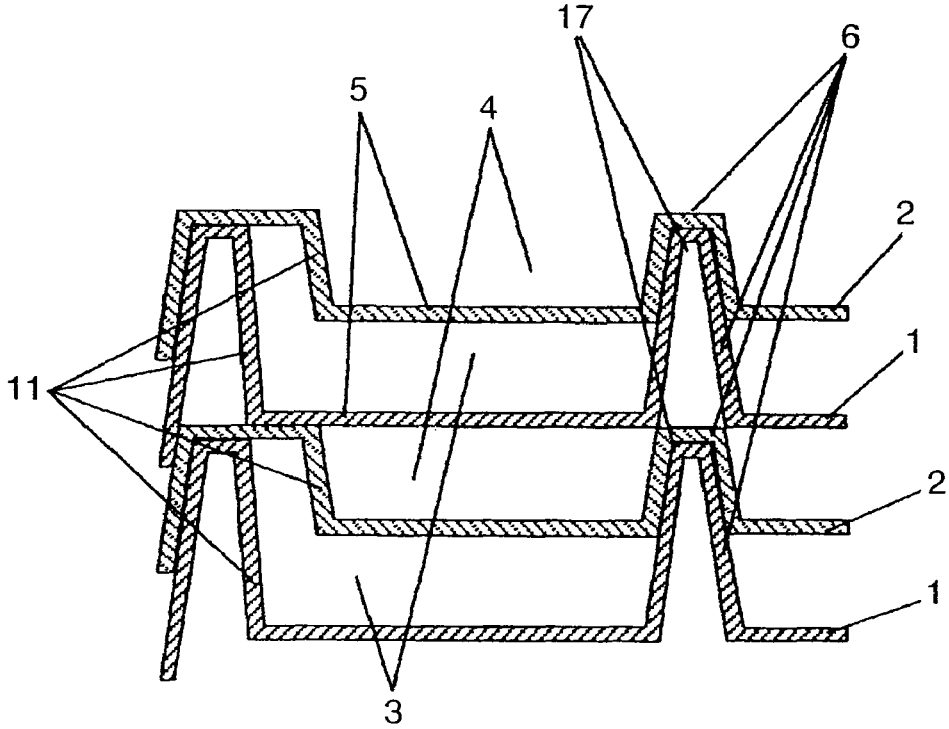
FIG. 11 is a section of a side portion of the heat exchanger in accordance with the second exemplary embodiment in the laminated state.

A description is provided of the second exemplary embodiment, with reference to FIGS. 9 through 11.

As shown in FIGS. 9 and 10, a plurality of third protrusions 17 formed into hollow protrusions in the protruding direction of air duct ribs 6 at a height equal to that of first protrusions 8 are provided on air duct ribs 6 substantially parallel to first outer peripheral ribs 11 on first heat conduction plates 1 and second heat conduction plates 2.

As shown in FIG. 11, the top surfaces of third protrusions 17 are in contact with the bottom surfaces of air duct ribs 6 on the heat conduction plates positioned thereon.

In the above structure, air duct ribs 6 on first heat conduction plates 1 and second heat conduction plates 2 are in vertically aligned positions. This structure can minimize the area of no heat exchange within a certain volume.

As a result, this structure provides a larger effective heat transfer area and heat exchange efficiency than a structure having air duct ribs 6 in vertically misaligned positions. Further, contact of the top surfaces of the plurality of third protrusions 17 on air duct ribs 6 in substantially the central portion of the heat exchanger with the bottom surfaces of air duct ribs 6 formed on the heat conduction plates positioned thereon can improve the strength against the weight of the plurality of laminated heat transfer plates and external force exerted from the top surface. As a result, the height of one heat conduction plane 5 is securely kept so that air duct ribs 6 do not collapse. This structure can secure the opening area of first air ducts 3 and second air ducts 4, and thus improve the heat exchange efficiency and reduce pressure loss.

Third Exemplary Embodiment

Figure 12:
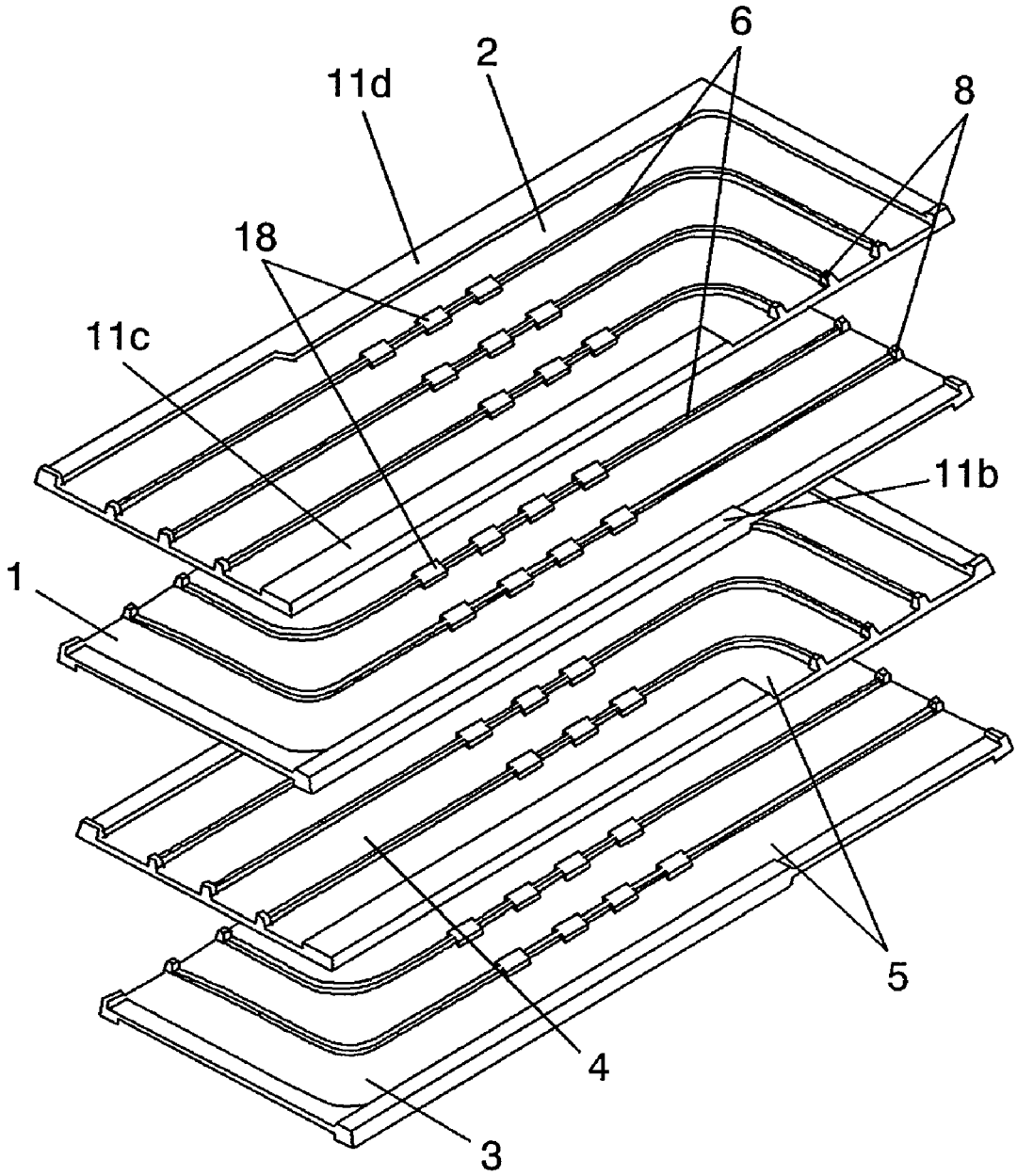
FIG. 12 is an exploded view in perspective of a heat exchanger in accordance with a third exemplary embodiment of the present invention.
Figure 13:
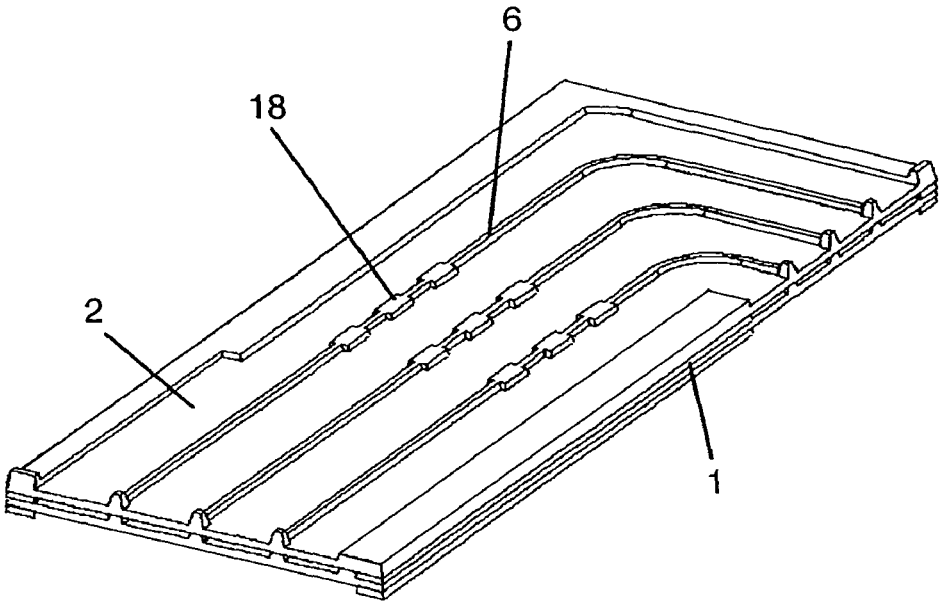
FIG. 13 is a perspective view illustrating the heat exchanger in accordance with the third exemplary embodiment in a laminated state.
Figure 14:
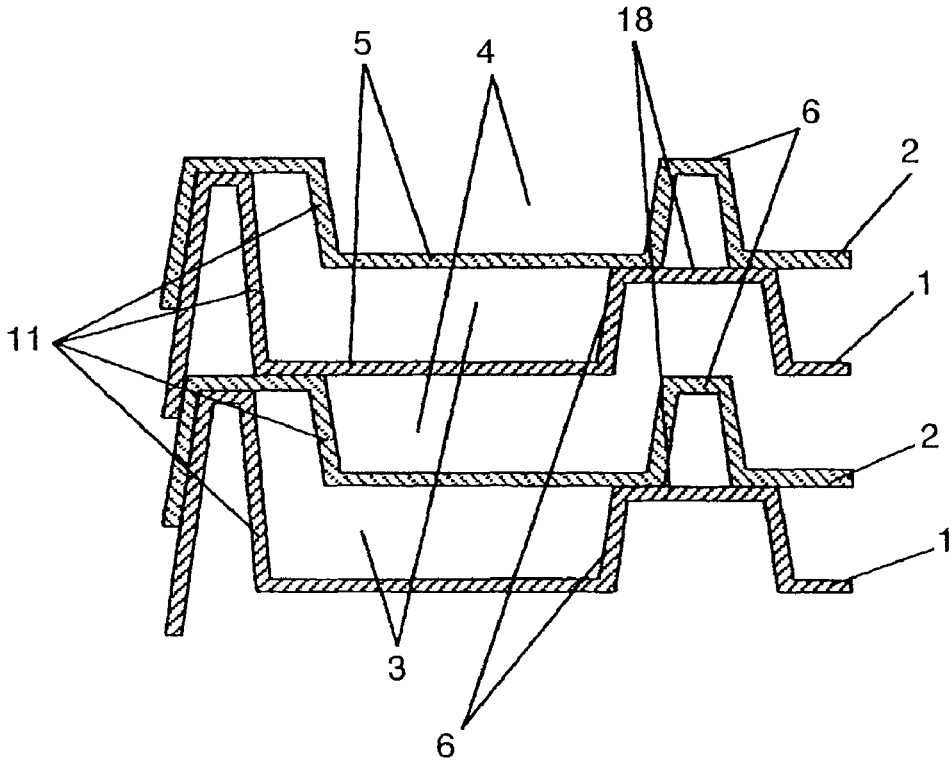
FIG. 14 is a section of a side portion of the heat exchanger in accordance with the third exemplary embodiment in the laminated state.

A description is provided of the third exemplary embodiment, with reference to FIGS. 12 through 14.

As shown in FIGS. 12 and 13, air duct rib laminations 18 formed by intermittently enlarging the width of air duct ribs 6 are provided on air duct ribs 6 substantially parallel to first outer peripheral ribs 11 on first heat conduction plates 1 and second heat conduction plates 2.

For example, while each of air duct ribs 6 is 2 mm wide, each of air duct rib laminations 18 is shaped 4 mm wide. As shown in FIG. 14, air duct rib laminations 18 on first heat conduction plates 1 and second heat conduction plates 2 are in misaligned positions in the lamination direction.

In the above structure, the width of each air duct rib 6 is intermittently enlarged in substantially the central portion of the heat exchanger, and thus the top surfaces of enlarged air duct rib laminations 18 are in contact with heat exchange surfaces 5 around air duct ribs 6 on the heat conduction plates positioned thereon. This contact can improve the strength of the heat exchanger against the weight of the plurality of laminated plates and external force exerted from the top surface thereof.

Such contact securely keeps the height of the one heat conduction plane so that air duct ribs 6 do not collapse, and secures the opening area of first air ducts 3 and second air ducts 4. As a result, the area of no heat exchange can be minimized within a certain volume to improve heat exchange efficiency and reduce pressure loss.

Fourth Exemplary Embodiment

Figure 15:
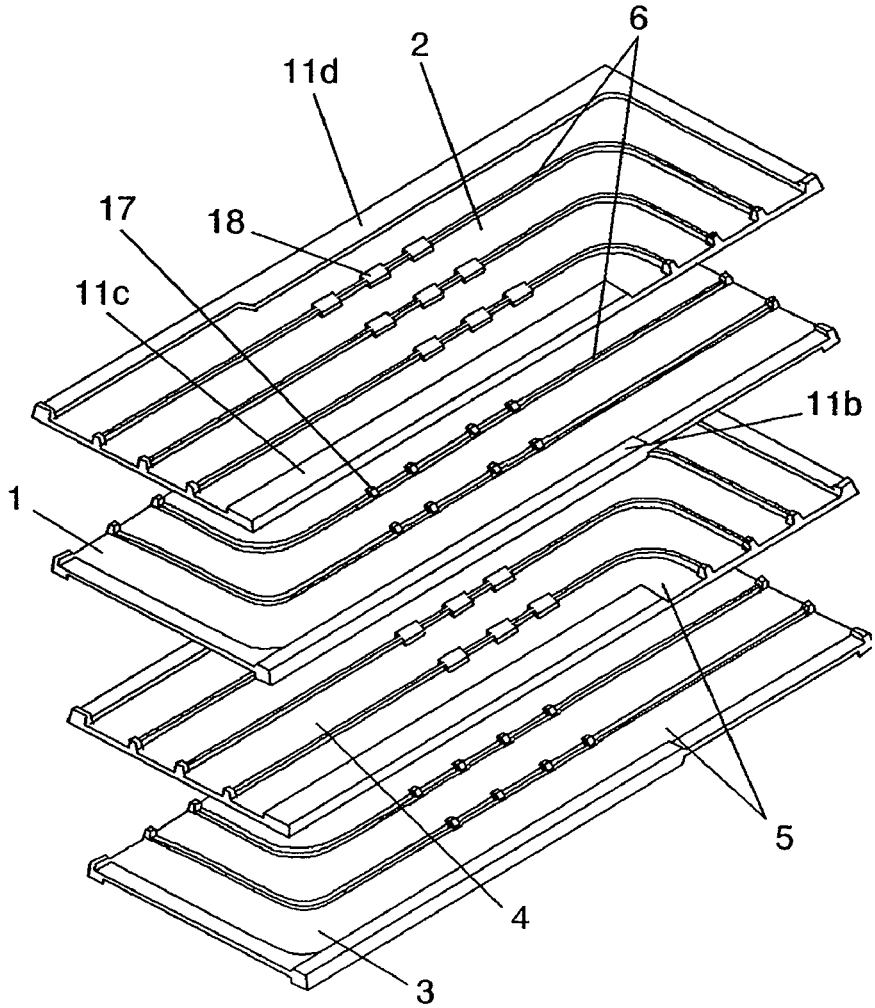
FIG. 15 is an exploded view in perspective of a heat exchanger in accordance with a fourth exemplary embodiment of the present invention.
Figure 16:
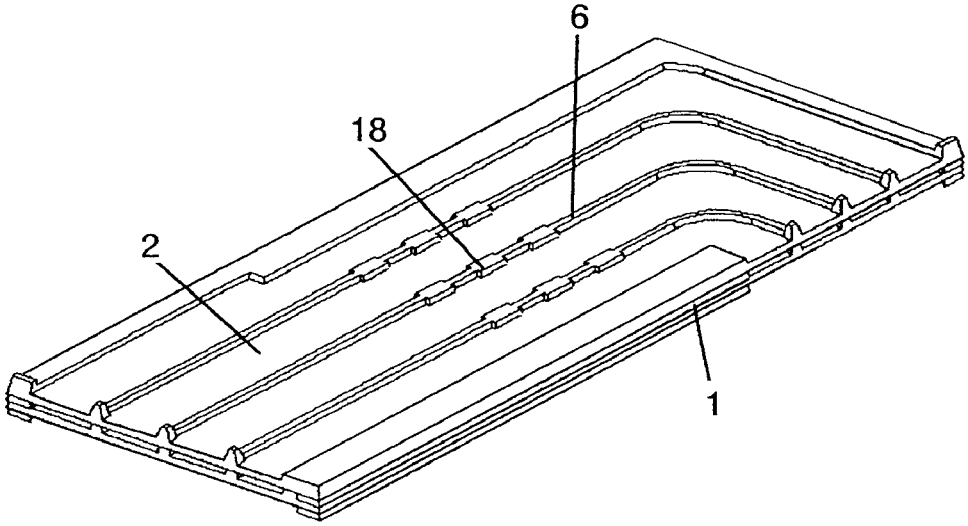
FIG. 16 is a perspective view illustrating the heat exchanger in accordance with the fourth exemplary embodiment in a laminated state.

A description is provided of the fourth exemplary embodiment, with reference to FIGS. 15 and 16.

As shown in FIGS. 15 and 16, a plurality of third protrusions 17 are provided on air duct ribs 6 substantially parallel to first outer peripheral ribs 11 on first heat conduction plates 1, and air duct rib laminations 18 formed by intermittently enlarging the width of the air duct ribs on second heat conduction plates 2. The top surfaces of third protrusions 17 are in contact with the bottom surfaces of air duct ribs 6 on second heat conduction plates 2 positioned thereon. The top surfaces of air duct rib laminations 18 are in contact with heat conduction planes 5 around air duct ribs 6 on first heat conduction plates 1 positioned thereon.

In this structure, the top surfaces of the plurality of third protrusions 17 formed on air duct ribs 6 on first heat conduction plates 1 in substantially a central portion of the heat exchanger are in contact with the bottom surfaces of air duct ribs 6 formed on second heat conduction plates 2 positioned thereon. Further, the top surfaces of air duct rib laminations 18 formed by intermittently enlarging the width of air duct ribs 6 on second heat conduction plates 2 are in contact with heat conduction planes 5 around air duct ribs 6 on first heat conduction plates 1 positioned thereon.

This contact can improve the strength against the weight of the plurality of laminated plates and external force exerted from the top surface, and allows the height of the one heat conduction plane 5 to be kept so that air duct ribs 6 do not collapse.

As a result, the opening area of first air ducts 3 and second air ducts 4 is secured. This can minimize the area of no heat exchange within a certain volume to improve heat exchange efficiency and reduce pressure loss.

Fifth Exemplary Embodiment

Figure 17:
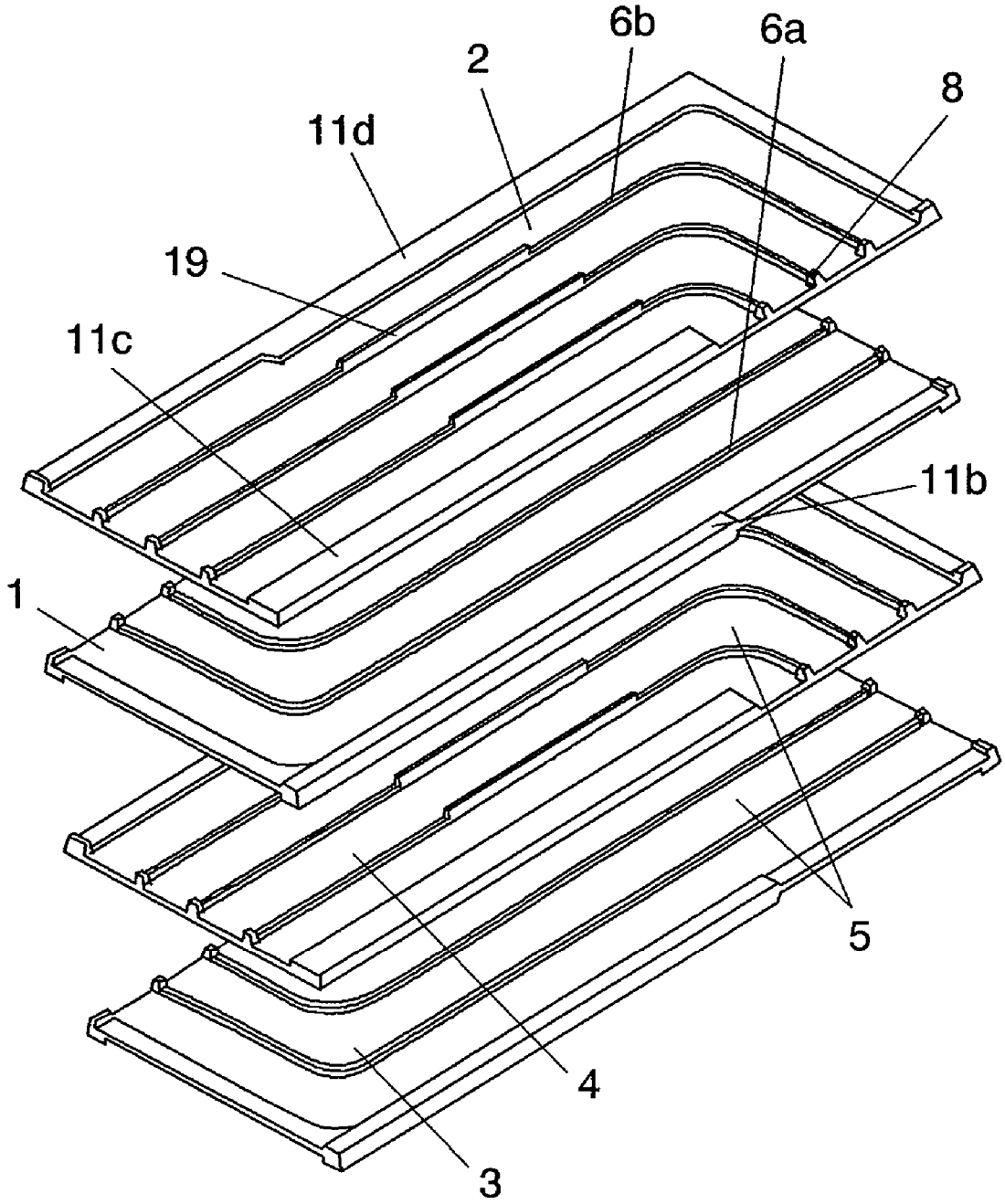
FIG. 17 is an exploded view in perspective of a heat exchanger in accordance with a fifth exemplary embodiment of the present invention.
Figure 18:
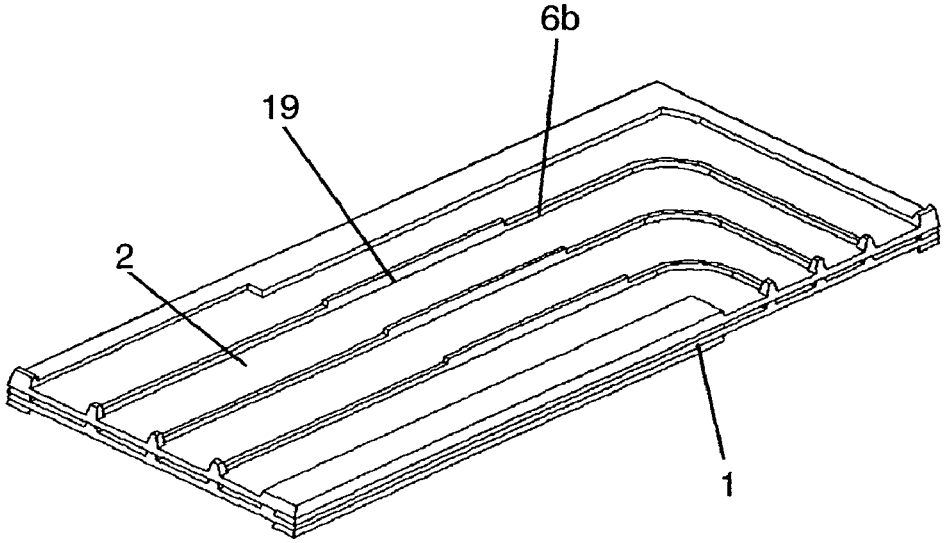
FIG. 18 is a perspective view illustrating the heat exchanger in accordance with the fifth exemplary embodiment in a laminated state.
Figure 19:
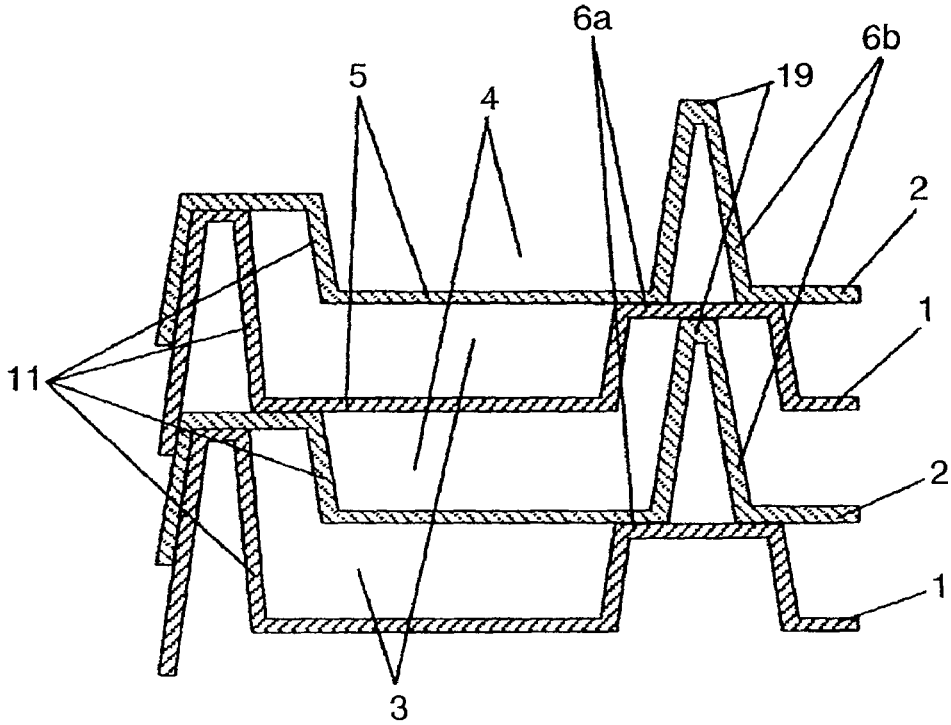
FIG. 19 is a section illustrating a side portion of the heat exchanger in accordance with the fifth exemplary embodiment in the laminated state.

A description is provided of the fifth exemplary embodiment, with reference to FIGS. 17 through 19.

As shown in FIGS. 17 and 18, in substantially the central portions of air duct ribs 6*b* on second heat conduction plates 2 substantially parallel to first outer peripheral ribs 11, air duct rib projections 19 are formed by increasing the height thereof to be equal to the height of first protrusions 8 in the protruding direction thereof. Further, air duct ribs 6*a* on first heat conduction plates 1 are made slightly larger in width than air duct ribs 6*b* on second heat conduction plates 2. For example, while each of air duct ribs 6*b* on second heat conduction plates 2 is 2 mm wide, each of air duct ribs 6*b* on first heat conduction plates 1 is 4 mm wide. As shown in FIG. 19, the top surfaces of air duct ribs 6*b* on second heat conduction plates 2 are in contact with the bottom surfaces of air duct ribs 6*a* on first heat conduction plates 1. Then, the top surfaces of slightly wider air duct ribs 6*a* on first heat conduction plates 1 are in contact with heat conduction planes 5 around air duct rib projections 19 on second heat conduction plates 2 positioned thereon.

In the above structure, the top surfaces of air duct rib projections 19 on second heat conduction plates 2 having a height equal to that of first protrusions 8 in the protruding direction thereof in substantially the central portion of a heat exchanger are in contact with the bottom surfaces of wider air duct ribs 6*a* on first heat conduction plates 1 positioned thereon. Further, heat conduction planes 5 around air duct rib projections 19 on second heat conduction plates are in contact with the top surfaces of air duct ribs 6*a* on first heat conduction plates 1 positioned thereunder. Such contact can improve the strength against the weight of the plurality of laminated heat conduction plates and external force exerted from the top surface, and allows the height of one heat conduction plane 5 to securely be kept so that air duct ribs 6 do not collapse. As a result, the opening area of first air ducts 3 and second air ducts 4 is secured. This can minimize the area of no heat exchange within a certain volume to improve heat exchange efficiency and reduce pressure loss.

Sixth Exemplary Embodiment

Figure 20:
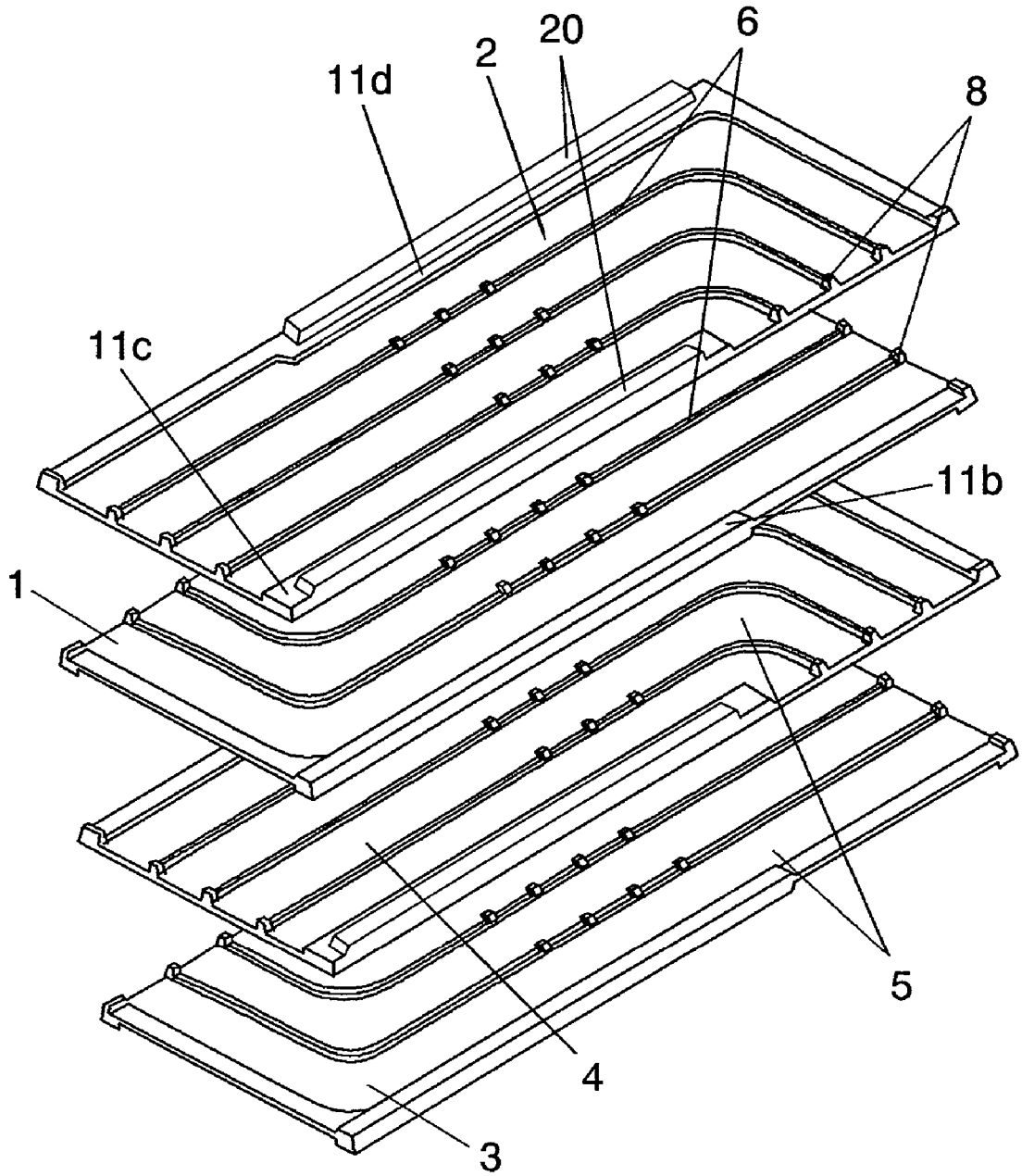
FIG. 20 is an exploded view in perspective of a heat exchanger in accordance with a sixth exemplary embodiment of the present invention.
Figure 21:
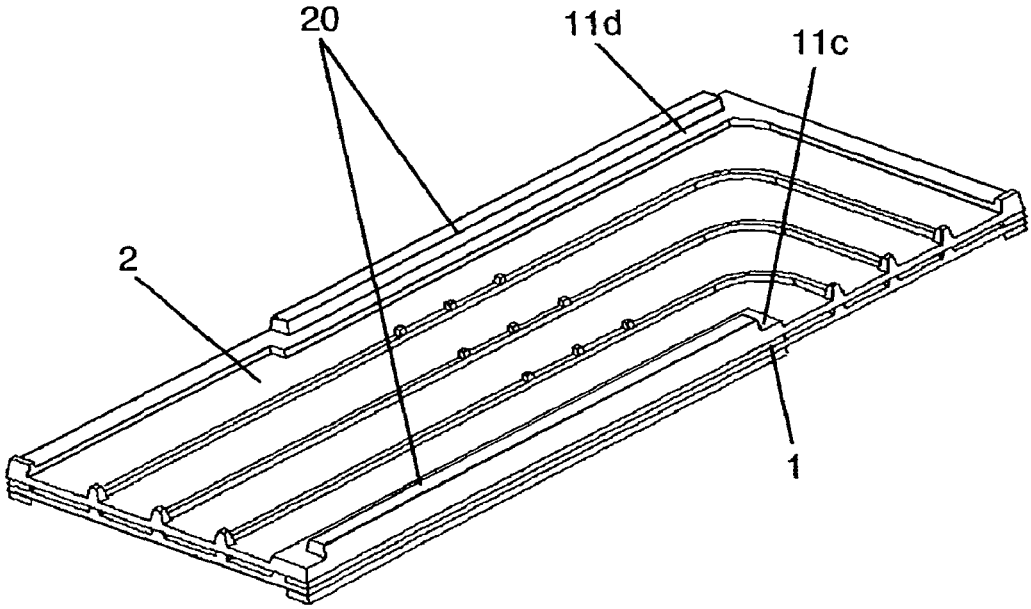
FIG. 21 is a perspective view illustrating the heat exchanger in accordance with the sixth exemplary embodiment in a laminated state.
Figure 22:
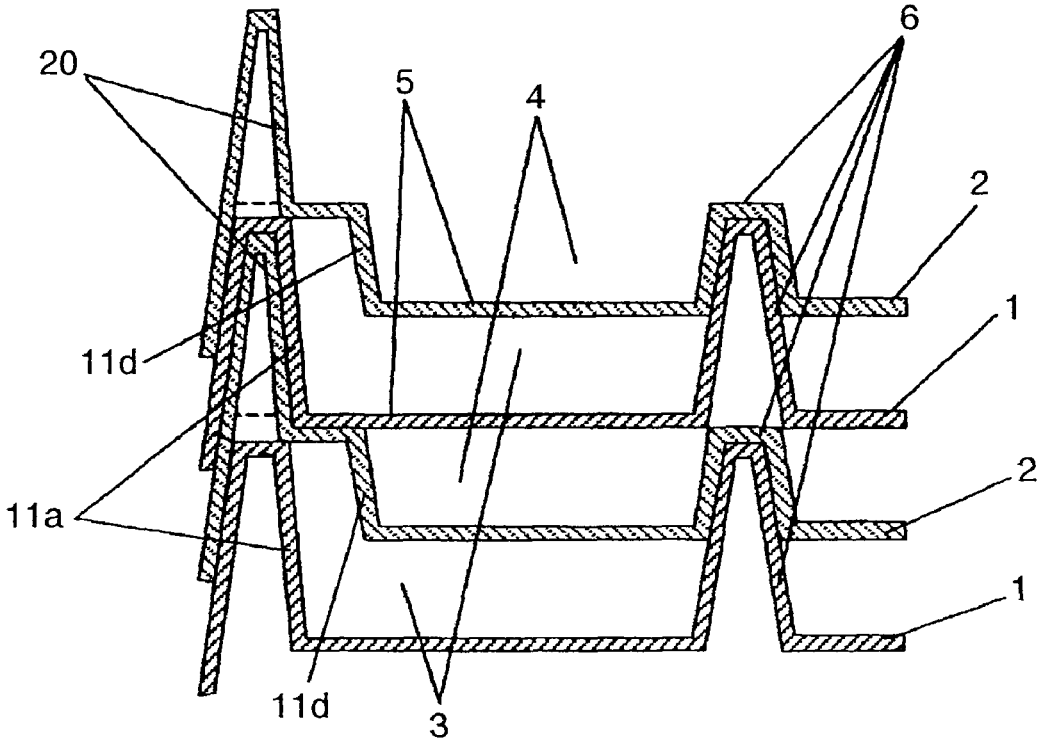
FIG. 22 is a section illustrating a side portion of the heat exchanger in accordance with the sixth exemplary embodiment in the laminated state.

A description is provided of the sixth exemplary embodiment, with reference to FIGS. 20 through 22.

As shown in FIGS. 20 and 21, side face reinforcing projections 20 are provided on the top surfaces of first outer peripheral ribs 11(*c* and *d*) on second heat conduction plates 2.

The width of each side face reinforcing projection 20 is 4 mm, for example, equal to the width of first outer peripheral ribs 11(*a* and *b*) on first heat conduction plates 1. Each projection 20 has a continuous height of 4 mm from the surfaces of first outer peripheral ribs 11(*c* and *d*).

As shown in FIG. 22, when first heat conduction plates 1 and second heat conduction plates 2 are alternately laminated, the top surfaces of first outer peripheral ribs 11(*a* and *b*) on first heat conduction plates 1 are in contact with the bottom surfaces of first outer peripheral ribs 11(*c* and *d*) on second heat conduction plates 2. The top surfaces of first outer peripheral ribs 11(*c* and *d*) on second heat conduction plates 2 are in contact with the bottom surfaces of heat conduction planes 5 on first heat conduction plates 1. Further, the top and side surfaces of side face reinforcing projections 20 formed on first outer peripheral ribs 11(*c* and *d*) on second heat conduction plates 2 are in contact with the bottom and side surfaces of first outer peripheral ribs 11(*a* and *b*) on first heat conduction plates 1, respectively.

In the above structure, when the adjacent outer side surfaces of first outer peripheral ribs 11 of a heat exchanger are heat-sealed, the hollow protrusions of first outer peripheral ribs 11(*a* and *b*) on first heat conduction plates 1 are in contact with side face reinforcing projections 20 on second heat conduction plates 2. When the heated heat conduction plates are melted and heat-sealed in this manner after temperature decrease, this structure prevents the side surfaces from being deformed by shrinkage resulting from temperature decrease. Further, this structure can prevent deterioration of air-tightness caused by deformation, and improve air-tightness of the side surfaces.

Figure 23:
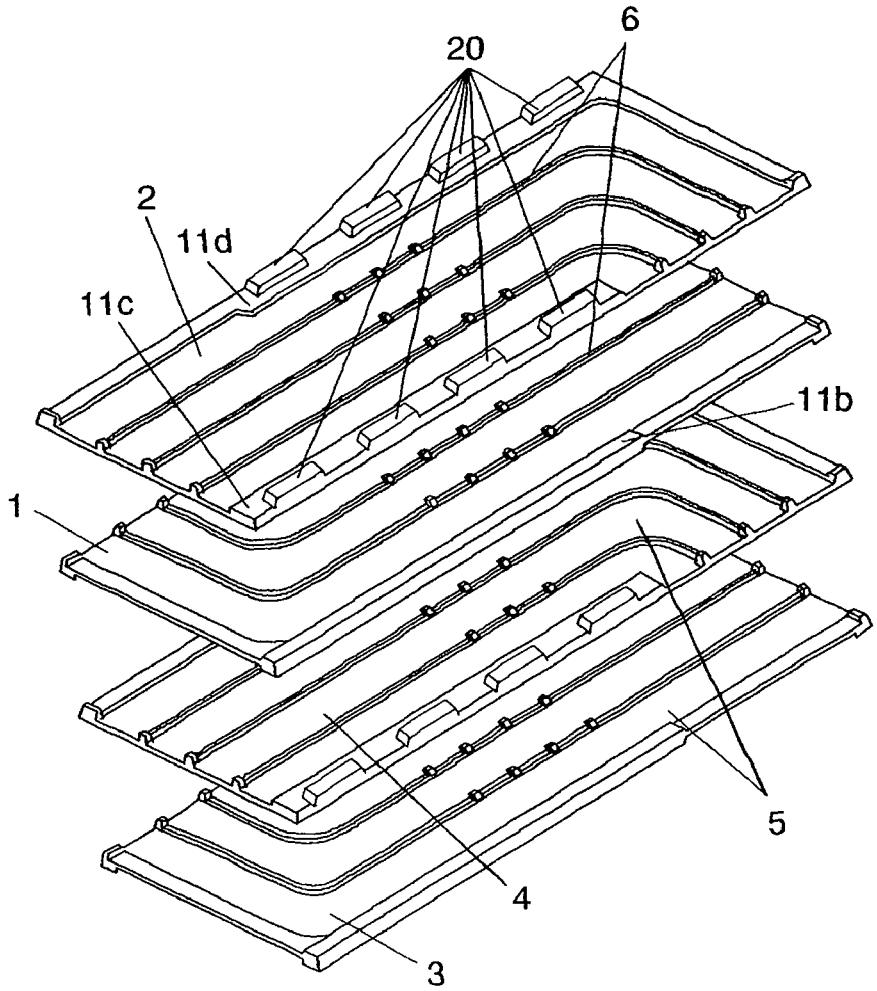
FIG. 23 is an exploded view in perspective of the heat exchanger in accordance with the sixth exemplary embodiment of the present invention.
Figure 24:
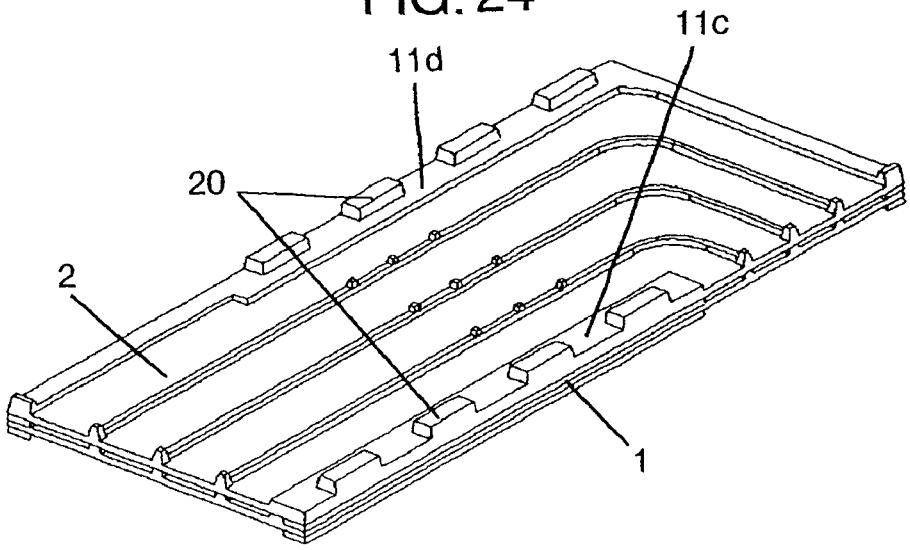
FIG. 24 is a perspective view illustrating the heat exchanger in accordance with the sixth exemplary embodiment in a laminated state.

In the description of this exemplary embodiment, side face reinforcing projections 20 have a continuous shape. However, as will be shown in FIGS. 23 and 24, a structure having intermittent side face reinforcing projections 20 can provide the similar advantages.

Seventh Exemplary Embodiment

Figure 25:
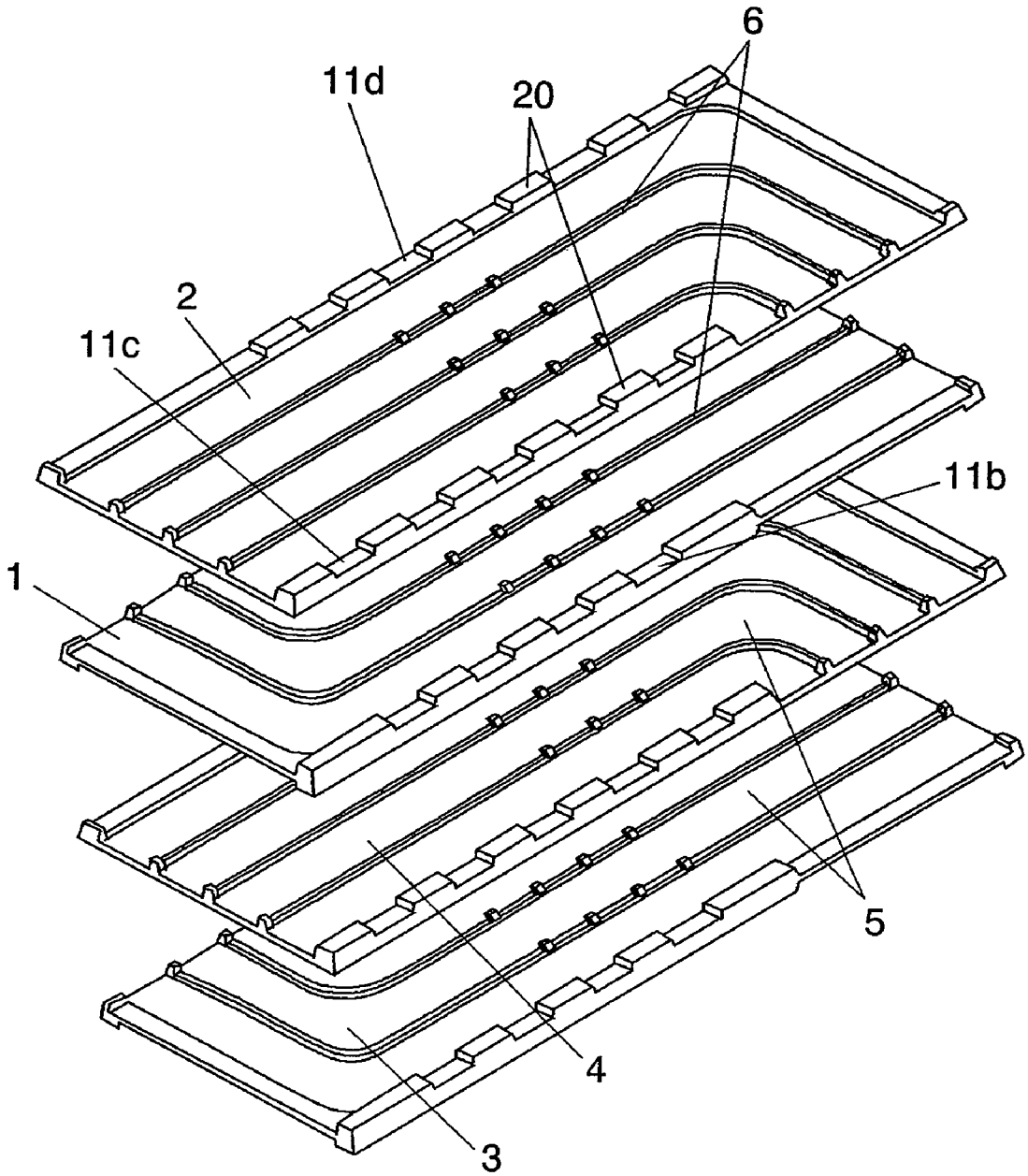
FIG. 25 is an exploded view in perspective of a heat exchanger in accordance with a seventh exemplary embodiment of the present invention.
Figure 26:
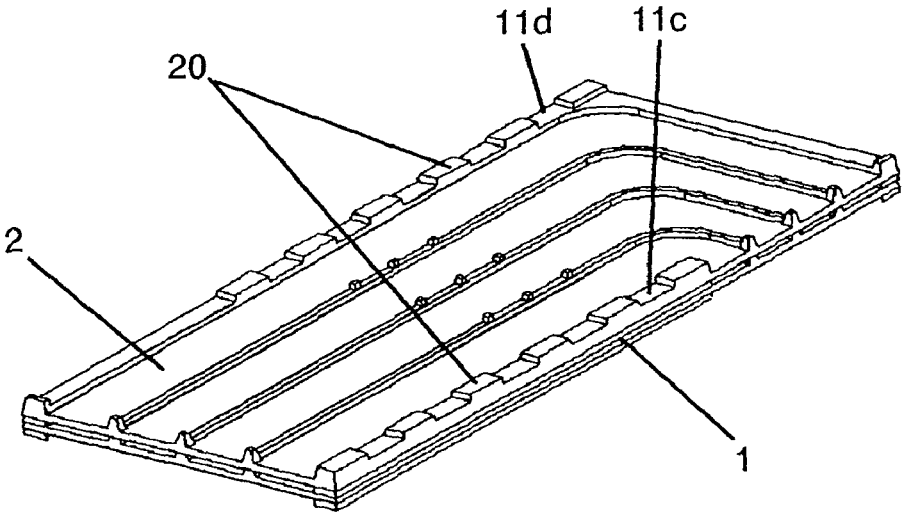
FIG. 26 is a perspective view of the heat exchanger in accordance with the seventh exemplary embodiment in a laminated state.
Figure 27:
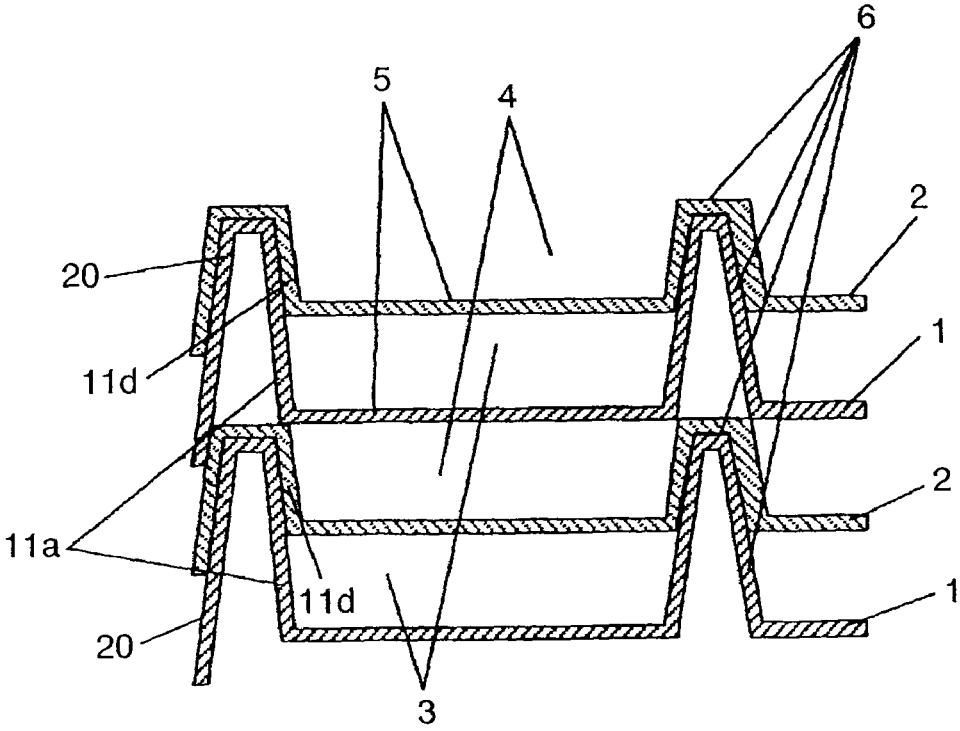
FIG. 27 is a section illustrating a side portion of the heat exchanger in accordance with the seventh exemplary embodiment in the laminated state.

A description is provided of the seventh exemplary embodiment, with reference to FIGS. 25 through 27. As shown in FIGS. 25 and 26, first outer peripheral ribs 11(*a, b, c*, and *d*) on first heat conduction plates 1 and second heat conduction plates 2 are 4 mm wide, for example. The projections of them are 2 mm high from heat conduction planes 5. Reference marks 11(*a, b, c*, and *d*) indicate four outer peripheries 11*a*, 11*b*, 11*c*, and 11*d*.

As shown in FIG. 27, first heat conduction plates 1 and second heat conduction plates 2 have intermittent side face reinforcing projections 20 on the top surfaces of first outer peripheral ribs 11. The width of each side face reinforcing projection 20 is 4 mm, equal to the width of first outer peripheral ribs 11(*a, b, c* and *d*), for example. The height of the projections is 2 mm from the surfaces of first outer peripheral ribs 11(*a, b, c* and *d*).

Side face reinforcing projections 20 on first heat conduction plates 1 and side face reinforcing projections 20 on second heat conduction plates 2 are formed in vertically misaligned positions in the lamination direction as follows. When first heat conduction plates 1 and second heat conduction plates 2 are alternately laminated, the top and side surfaces of side face reinforcing projections 20 on first heat conduction plates 1 are in contact with the bottom and side surfaces of first outer peripheral ribs 11(*c* and *d*) on second heat conduction plates 2, respectively. The top and side surfaces of side face reinforcing projections 20 on second heat conduction plates 2 are in contact with the bottom and side surfaces of first outer peripheral ribs 11(*a* and *b*) on first heat conduction plates 1, respectively.

In the above structure, when the adjacent outer side surfaces of first outer peripheral ribs 11 of a heat exchanger are heat-sealed, the hollow protrusions of first outer peripheral ribs 11 on first heat conduction plates 1 are in contact with the side face reinforcing projections 20 on second heat conduction plates 2, and the hollow protrusions of first outer peripheral ribs 11 on second heat conduction plates 2 are in contact with side face reinforcing projections 20 on first heat conduction plates 1. Then, when the heated heat conduction plates are melted and heat-sealed after temperature decrease, this structure prevents the side surfaces from being deformed by shrinkage resulting from the temperature decrease. Further, this structure can prevent deterioration of air-tightness caused by deformation, and improve air-tightness of the side surfaces.

Eighth Exemplary Embodiment

Figure 28:
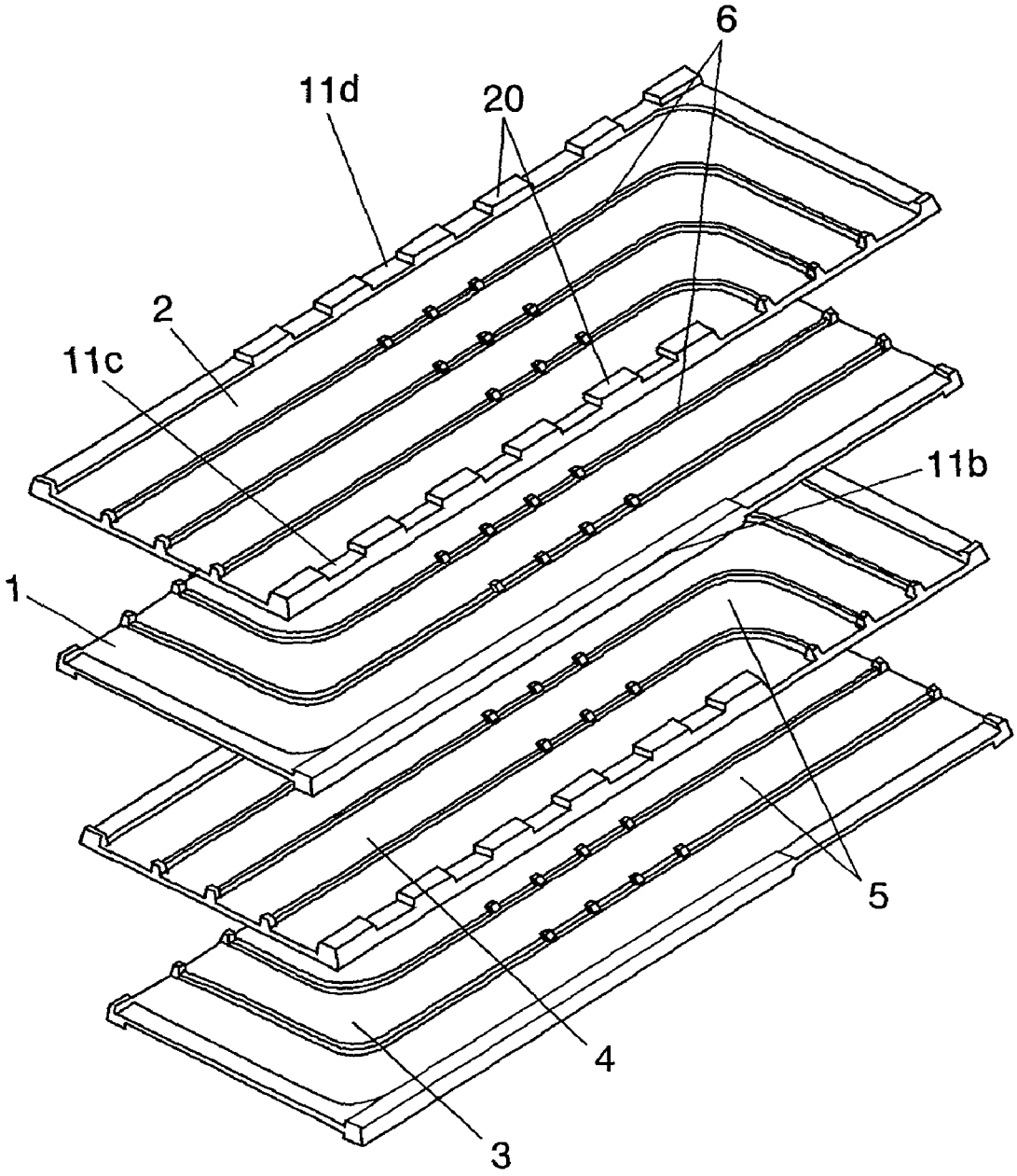
FIG. 28 is an exploded view in perspective of a heat exchanger in accordance with an eighth exemplary embodiment of the present invention.
Figure 29:
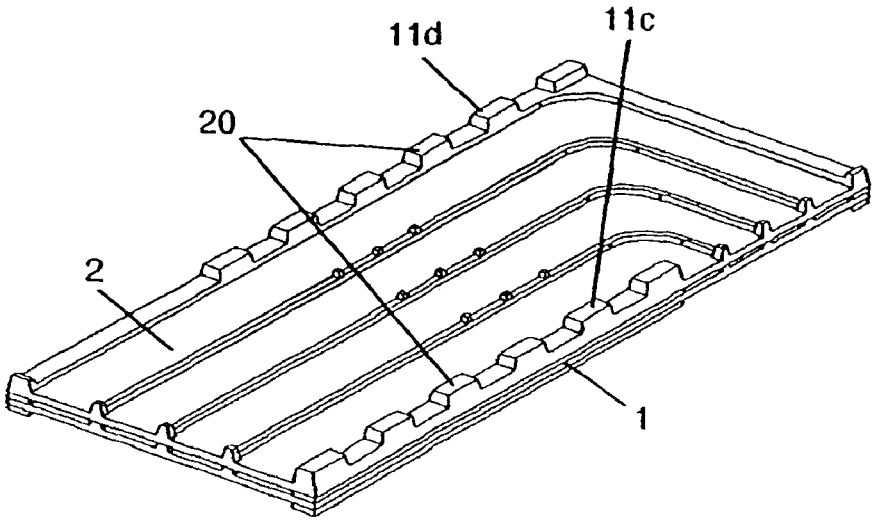
FIG. 29 is a perspective view illustrating the heat exchanger in accordance with the eighth exemplary embodiment in a laminated state.
Figure 30:
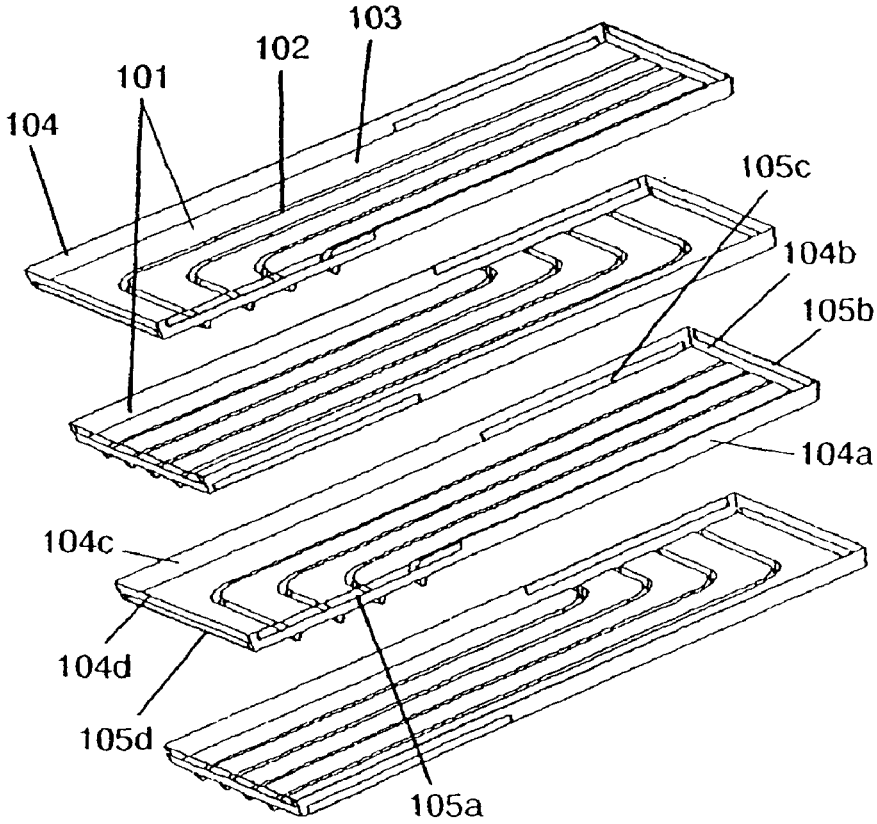
FIG. 30 PRIOR ART
FIG. 30 is a perspective view of unit components of a conventional heat exchanger.
Figure 31:
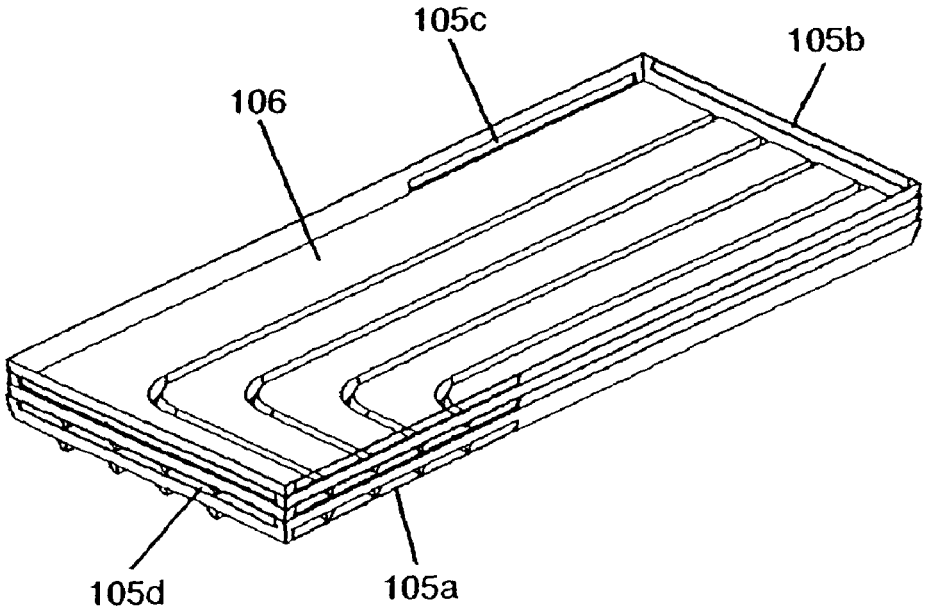
FIG. 31 PRIOR ART
FIG. 31 is a perspective view of the conventional heat exchanger in a laminated state.
Figure 32:
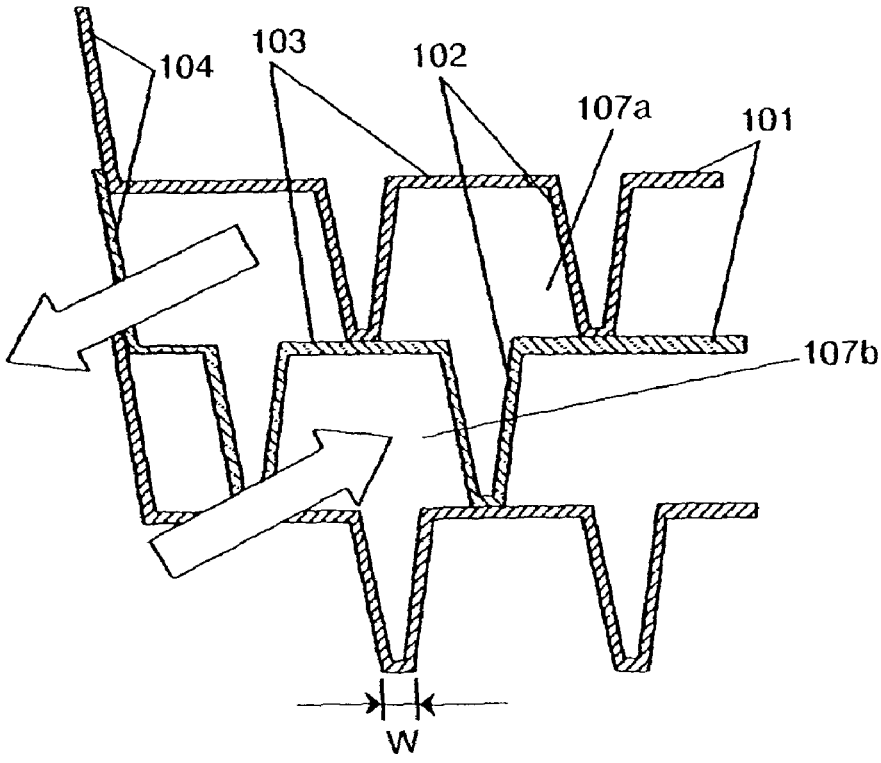
FIG. 32 PRIOR ART
FIG. 32 is a section of a central portion of the conventional heat exchanger in the laminated state.

A description is provided of the eighth exemplary embodiment, with reference to FIGS. 28 through 29.

As shown in FIGS. 28 and 29, first outer peripheral ribs 11(*a, b, c*, and *d*) on first heat conduction plates 1 and second heat conduction plates 2 are 4 mm wide, for example. The projections of the first heat conduction plates 1 are 4 mm high from the surface of heat conduction planes 5. Those of the second heat conduction plates are 2 mm high from the surface of heat conduction planes 5.

Further, second heat conduction plates 2 have intermittent side face reinforcing projections 20 on the top surfaces of first outer peripheral ribs 11(*c* and *d*). The width of each side face reinforcing projection 20 is 4 mm, for example, equal to the width of first outer peripheral ribs 11(*c* and *d*). The height the projections is 4 mm from the surfaces of first outer peripheral ribs 11(*c* and *d*).

When first heat conduction plates 1 and second heat conduction plates 2 are alternately laminated, the top and side surfaces of first outer peripheral ribs 11(*a* and *b*) on first heat conduction plates 1 are in contact with the bottom and side surfaces of first outer peripheral ribs 11(*c* and *d*) on second heat conduction plates 2, respectively. The top and side surfaces of side face reinforcing projections 20 on first outer peripheral ribs 11(*c* and *d*) formed on second heat conduction plates 2 are in contact with the bottom and side surfaces of first outer peripheral ribs 11(*a* and *b*) formed on first heat conduction plates 1, respectively.

In the above structure, when the adjacent outer side surfaces of first outer peripheral ribs 11 of a heat exchanger are heat-sealed, the hollow protrusions of first outer peripheral ribs 11(*a* and *b*) on first heat conduction plates 1 are in contact with the side face reinforcing projections 20 on second heat conduction plates 2. Then, when the heated heat conduction plates are melted and heat-sealed after temperature decrease, this structure prevents the side surfaces from being deformed by shrinkage resulting from temperature decrease. Further, this structure can prevent deterioration of air-tightness caused by deformation, and improve air-tightness of the side surfaces.

As obvious form these exemplary embodiments, in the present invention, contact of the top surfaces of the first outer peripheral ribs and second outer peripheral ribs with the heat conduction plates positioned thereon can tightly seal the first and second air ducts, and improve the air-tightness of the entire heat exchanger. In this structure, the cross-linking effect of the first protrusions in communication with the air duct end faces and a plurality of substantially L-shaped air duct ribs prevent deformation of the lateral side surfaces. Further, contact of the first outer peripheral ribs formed into hollow protrusions by the heat conduction planes with each other provides strength against lateral external force higher than that of the side surfaces of a heat exchanger made by simply folding the outer peripheries of the heat conduction plate. Contact of the first outer peripheral ribs, second outer peripheral ribs, first protrusions, second protrusions, air duct ribs and heat exchange surfaces on the heat conduction plates can securely keep the height of one heat exchange surface so that the air ducts ribs do not collapse. As a result, this structure can secure the opening area of the first and second air ducts to reduce pressure loss.

The first heat conduction plate and second heat conduction plate are integrally molded, using a molding die that has square parts continuing to the outer side surfaces of the second outer peripheral ribs thereof and having a sectional shape identical to that of the slots formed in the outer side surfaces of the second outer peripheral ribs. Because the first heat conduction plate and second heat conduction plate can be cut at a time using a Thompson type die or the like, a heat exchanger with improved productivity can be provided.

When heat is exchanged by airflows through the first air ducts and second air ducts formed by alternately laminating the first heat conduction plates and second heat conduction plates, no heat is exchanged in the air duct ribs formed into substantially L-shaped hollow protrusions by the heat conduction plates.

Placing the air duct ribs on the first heat conduction plates and second heat conduction plates in substantially vertically aligned positions can minimize the area of no heat exchange within a certain volume. As a result, this structure can provide a heat exchanger having effective heat transfer area and heat exchange effectiveness larger than those of a structure having heat conduction plates with the air duct ribs in vertically misaligned positions.

Alternatively, contact of the top surfaces of a plurality of third protrusions on air duct ribs in substantially the central portion of a heat exchanger with the bottom surfaces of the air duct ribs on the heat conduction plates positioned thereon can improve the strength thereof against the weight of the plurality of laminated heat conduction plates and external force exerted from the top surface.

In this manner, this structure can securely keep the height of one heat conduction plane so that the air duct ribs do not collapse, and the opening area of the first and second air ducts. Thus, this structure can provide a heat exchanger having a minimized area of no heat exchange within a certain volume, to improve heat exchange efficiency and reduce pressure loss.

Alternatively, the width of the air duct ribs in substantially the central portion of a heat exchanger is intermittently enlarged, and thus the top surfaces of the enlarged air duct ribs are in contact with the heat conduction planes around the air duct ribs on the heat conduction plates positioned thereon.

This structure can improve the strength against the weight of the plurality of laminated plates and external force exerted from the top surface, and can securely keep the height of one heat conduction plane so that the air duct ribs do not collapse.

Securing the opening area of the first air ducts and second air ducts can provide a heat exchanger having a minimized area of no heat exchange within a certain volume to improve heat exchange efficiency and reduce pressure loss.

Alternatively, the top surfaces of the plurality of third protrusions formed on the air duct ribs on the first heat conduction plates or the second heat conduction plates in substantially the central portion thereof are in contact with the bottom surfaces of the air duct ribs formed on the other heat conduction plates positioned thereon. Further, the width of the air duct ribs on the other heat conduction plates is intermittently enlarged. Contact of the top surfaces of the wider air duct ribs with the heat conduction planes around the air duct ribs formed on the heat conduction plates positioned thereon can improve the strength against the weight of the plurality of laminated heat transfer plates and external force exerted from the top surface.

This structure can securely keep the height of the one heat conduction plane so that the air duct ribs do not collapse, and the opening area of the first air ducts and second air ducts. As a result, this structure can provide a heat exchanger having a minimized area of no heat exchange within a certain volume to improve heat exchange efficiency and reduce pressure loss.

Alternatively, the top surfaces of the air duct ribs each having a height equal to that of the first protrusions in substantially the central portion of a heat exchanger are in contact with the bottom surfaces of wider air duct ribs on the heat conduction plates positioned thereon.

Further, the heat conduction planes around air duct ribs each having a height equal to that of the first protrusions in the protruding direction are in contact with the top surfaces of the wider air duct ribs on the heat conduction plates positioned thereunder. Such contact can improve the strength against the weight of the plurality of laminated heat conduction plates and external force exerted from the top surface, and can securely keep the height of one heat conduction plane so that the air duct ribs do not collapse.

Securing the opening area of the first air ducts and second air ducts can provide a heat exchanger having a minimized area of no heat exchange within a certain volume to improve heat exchange efficiency and reduce pressure loss.

Further, the top surfaces of second protrusions provided on the second outer peripheral ribs are in contact with the bottom surfaces of the second outer peripheral ribs on the heat conduction plates positioned thereon.

Such contact can improve the strength of the corner portions of the heat exchanger against the weight of the plurality of laminated heat conduction plates and external force exerted from the top surface.

Further, contact of the end faces of the second protrusions provided on the second outer peripheral ribs with the air duct end face covers formed on the heat conduction plates positioned thereon can provide a heat exchanger having improved air-tightness at the corners thereof.

Alternatively, when the adjacent outer side surfaces of the first outer peripheral ribs of a heat exchanger are heat-sealed, hollow protrusions of the first outer peripheral ribs on the first heat conduction plates are in contact with side face reinforcing projections on second heat conduction plates. In this manner, when the heated heat conduction plates are melted and heat-sealed after temperature decrease, this structure prevents the side surfaces from being deformed by shrinkage resulting from temperature decrease.

As a result, this structure can provide a heat exchanger in which deterioration of air-tightness caused by deformation can be prevented and air-tightness of the side surfaces can be improved.

Alternatively, when the adjacent outer side surfaces of the first outer peripheral ribs of a heat exchanger are heat-sealed, the hollow protrusions of the first outer peripheral ribs on the first heat conduction plates are in contact with the side face reinforcing projections on the second heat conduction plates, and the hollow protrusions of the first outer peripheral ribs on the second heat conduction plates are in contact with the side face reinforcing projections on the first heat conduction plates.

In this manner, when the heated heat conduction plates are melted and heat-sealed after temperature decrease, this structure prevents the side surfaces from being deformed by shrinkage resulting from temperature decrease. Further, this structure prevents deterioration of air-tightness caused by deformation.

As a result, a heat exchanger with improved air-tightness can be provided.

Alternatively, by dispersing rubber particles in resin of the sheet material, the elasticity of the rubber can prevent cracks of the first heat conduction plates and second heat conduction plates during vacuum molding. Further, this material can improve the impact resistance of a heat exchanger obtained by alternately laminating the first heat conduction plates and second heat conduction plates, and thus improve the strength thereof against cracks and impacts.

As a result, this material can provide a heat exchanger in which deterioration of air-tightness caused by cracks of the first heat conduction plates and second heat conduction plates can be prevented and thus air-tightness can be improved.

The substantially square shape in the present invention indicates a shape in which four openings in total, i.e. the inlets and outlets of the first and second air ducts, are positioned independently along the respective four sides of each heat conduction plate.

The substantially L shape in the present invention indicates a curved state in which the inlets and outlets of the first and second air ducts are not positioned in the same plane.

The air-tightness in the present invention can be ensured by providing air duct end faces along the inlets and outlets of the air ducts, and bringing the air duct end faces of a first heat conduction plate into contact with the side surfaces of the outer peripheral ribs on a second heat conduction plate adjacent to the first heat conduction plate, and the air duct end faces on the second heat conduction plate into contact with the side surfaces of the outer peripheral ribs on the first heat conduction plate adjacent to the second heat conduction plate.

INDUSTRIAL APPLICABILITY

The present invention provides a heat exchanger having improved basic performance, e.g. improving heat exchange efficiency and reducing pressure loss, as well as improved productivity and strength.

The present invention can be used for heat exchange ventilators or air conditioners using heat exchangers.

The invention claimed is:

1. A heat exchanger comprising:

a first heat conduction plate and a second heat conduction plate both in substantially a square shape, each of the first and second heat conduction plates including:

a plurality of substantially L-shaped air duct ribs forming a plurality of substantially L-shaped air ducts and heat conduction planes;

a first outer peripheral rib for shielding leak of fluid flowing through the air ducts to an outside of the heat conduction plate;

a second outer peripheral rib for shielding leak of fluid flowing through the air ducts to an outside of the heat conduction plate wherein a protrusion is formed into a hollow protrusion in the protruding direction of the air duct ribs is provided at an air duct end face side of the second outer peripheral rib, and the protrusion has a height greater than a height of the plurality of air duct ribs; and air-tightness ensuring means;

wherein the first heat conduction plate and the second heat conduction plate are integrally molded of one sheet material, and are alternately laminated on top of each other.

2. The heat exchanger of claim 1, wherein the air-tightness ensuring means includes an air duct end face along each of inlets and outlets of the plurality of air ducts, and the air duct end face of the first heat conduction plate is in contact with a side surface of the outer peripheral rib on the second heat conduction plate adjacent to the first heat conduction plate, and the air duct end face of the second heat conduction plate is in contact with a side surface of the outer peripheral rib on the first heat conduction plate adjacent to the second heat conduction plate.

3. The heat exchanger of claim 1, wherein the sheet material contains rubber particles dispersed in a resin.

4. The heat exchanger of claim 3, wherein the resin is a styrene-based resin.

5. The heat exchanger of claim 3, wherein the resin is high impact polystyrene.

6. The heat exchanger of claim 3, wherein the resin is an ABS resin.

7. The heat exchanger of claim 1, wherein the protrusions on one of the first heat conduction plate and the second heat conduction plate are substantially orthogonal to the protrusions on an other one of the first and second heat conduction plates positioned on the one of the first and second heat conduction plates; and the top surfaces of the second protrusions provided on one of the first and second heat exchange plate are in contact with bottom surfaces of the second outer peripheral ribs on an other one of the first and second heat conduction plates positioned on the one of the first and second heat conduction plates.

8. A heat exchanger comprising:

a first heat conduction plate and a second heat conduction plate both in substantially a square shape, the first heat conduction plate including:

a plurality of substantially L-shaped air duct ribs formed into hollow protrusions substantially parallel to each other at substantially an equal spacing, the plurality of air duct ribs forming a plurality of substantially L-shaped air ducts and heat conduction planes;

air duct end faces provided along an inlet and outlet of the air ducts so as to orthogonal to the inlet and outlet, formed by bending the heat conduction planes in a direction opposite to a protruding direction of the air duct ribs;

a plurality of first hollow protrusions provided at both ends of each of the air duct ribs in the protruding direction of the air duct ribs, each protrusion having a side surface substantially parallel to the air duct end faces, and a height larger than that of the plurality of air duct ribs in the protruding direction thereof;

a first outer periphery (a) sandwiched between the inlet and outlet of the air ducts, and a first outer periphery (b) diagonal thereto both provided along outer peripheries of the first heat conduction plate other than the inlet and outlet of the air ducts, the first outer peripheries (a, b) being substantially parallel to substantially central portions of the plurality of L-shaped air duct ribs; and a pair of second outer peripheries (a, b) provided along outer peripheries adjacent to the inlet and outlet of the air ducts on an opposite side of first outer periphery (a), the second outer periphery (a) being substantially parallel to first outer peripheries (a, b), the second outer periphery (b) being substantially orthogonal to first outer peripheries (a, b), wherein, each of the first outer peripheries (a, b) includes a first outer peripheral rib formed by the heat conduction planes into a hollow protrusion in the protruding direction of the air duct ribs and having a height larger than that of the air duct ribs in the protruding direction thereof, an outer side surface of the first outer peripheral rib is bent in a direction opposite to the protruding direction of the air duct ribs so as to have a height larger than that of the first outer peripheral rib from the heat conduction planes in the protruding direction thereof; and each of the second outer peripheries (a, b) includes a second outer peripheral rib formed by the heat conduction planes into a hollow protrusion in the protruding direction of the air duct ribs and having a height equal to that of the air duct ribs in the protruding direction thereof, and a central portion of an outer side surface of each of the second outer peripheral ribs is bent to a same surface of the heat conduction planes so as to have a slot therein; and each of air duct end face covers bent to a same position to which the air duct end faces are bent is provided at each end of the outer side surfaces of the second outer peripheral ribs, a second protrusion formed into a hollow protrusion in the protruding direction of the air duct ribs is provided at an air duct end face side of each second outer peripheral rib, and the second protrusion has a height equal to the height of the first protrusions in a protruding direction thereof; and the second heat conduction plate analogous to the first heat conduction plate wherein, in the second heat conduction plate, a height of a first outer peripheral rib is equal to the height of the air duct ribs in the protruding direction thereof, and a width of the first outer peripheral rib is larger than a width of the first outer peripheral ribs on the first heat conduction plate;

wherein, the first heat conduction plate and the second heat conduction plate are integrally molded of one sheet material, and are alternately laminated so that the first outer peripheral ribs on the second heat conduction plate overlaps the first outer peripheral ribs on the first heat conduction plate;

laminating the first heat conduction plate and the second heat conduction plate forms first air ducts and second air ducts alternately;

when the first heat conduction plate and the second heat conduction plate are alternately laminated, top surfaces of the air duct ribs, first protrusions, first outer peripheral ribs, second outer peripheral ribs, and second protrusions on one of the first and second heat conduction plates are in contact with an other one of the first and second heat conduction plates laminated thereon, the side surfaces of the first protrusions on one of the first and second heat conduction plates parallel to the air duct end faces are in contact with inner side surfaces of the corresponding second outer peripheral ribs provided on an other one of the first and second heat conduction plates positioned on the one of the first and second heat conduction plates, the air duct end faces of one of the heat conduction plates are in contact with the outer side surfaces of the corresponding second outer peripheral ribs on an other one of the heat conduction plates positioned under the one of the heat conduction plates, side surfaces of the first outer peripheral ribs provided on the first and second heat conduction plates are in contact with each other, and the air duct end face covers on one of the first and second heat conduction plates are in contact with the corresponding first outer peripheral ribs and the second protrusions provided at end faces of the corresponding second outer peripheral ribs on an other of the first and second heat conduction plates positioned under the one of the first and second heat conduction plates.

9. The heat exchanger of claim 8, wherein the air duct ribs on the first heat conduction plate and second heat conduction plate are in vertically aligned positions, in substantially central portions of the air duct ribs substantially parallel to the first outer peripheral ribs.

10. The heat exchanger of claim 9, further comprising:

a plurality of third protrusions formed into hollow protrusions in the protruding direction of the air duct ribs, on substantially the central portions of the air duct ribs substantially parallel to the first outer peripheral ribs on the first heat conduction plate and the second heat conduction plate wherein each of the third protrusions has a height equal to that of the first protrusions in the protruding direction thereof; and top surfaces of the third protrusions on one of the first and second heat conduction plates are in contact with bottom surfaces of the air duct ribs on an other one of the first and second heat conduction plates positioned on the one of the first and second heat conduction plates.

11. The heat exchanger of claim 9, wherein, in substantially the central portions of the air duct ribs substantially parallel to the first outer peripheral ribs, a width of the air duct ribs on at least one of the first heat conduction plate and the second heat conduction plate is intermittently enlarged.

12. The heat exchanger of claim 9, wherein the plurality of third protrusions are provided on substantially the central portions of the air duct ribs substantially parallel to the first outer peripheral ribs on at least one of the first heat conduction plate and the second heat conduction plate; and a width of the air duct ribs on an other one of the first heat conduction plate and the second heat conduction plate is intermittently enlarged.

13. The heat exchanger of claim 9, wherein the height of the air duct ribs on one of the first heat exchange plate and the second heat conduction plate is equal to the height of the first protrusions in the protruding direction thereof; and a width of the air duct ribs on an other one of the first heat conduction plate and the second heat conduction plate is larger than the width of the air duct ribs on the one of the first and second heat conduction plates.

14. The heat exchanger of claim 8, wherein the second protrusions on one of the first heat conduction plate and the second heat conduction plate are substantially orthogonal to the second protrusions on an other one of the first and second heat conduction plates positioned on the one of the first and second heat conduction plates; and the top surfaces of the second protrusions provided on one of the first and second heat exchange plate are in contact with bottom surfaces of the second outer peripheral ribs on an other one of the first and second heat conduction plates positioned on the one of the first and second heat conduction plates.

15. The heat exchanger of claim 8, further comprising:

side face reinforcing projections provided on the top surfaces of the first outer peripheral ribs on the second heat conduction plate, wherein, when the first heat conduction plate and the second heat conduction plate are alternately laminated, the top surfaces of the first outer peripheral ribs on the first heat conduction plate are in contact with the bottom surfaces of the first outer peripheral ribs on the second heat conduction plate;

the top surfaces of the first outer peripheral ribs on the second heat conduction plate are in contact with bottom surfaces of the heat conduction planes on the first heat conduction plate; and top and side surfaces of the side face reinforcing projections on the first outer peripheral ribs on the second heat conduction plate are in contact with the bottom and side surfaces of the first outer peripheral ribs on the first heat conduction plate, respectively.

16. The heat exchanger of claim 15, wherein the side face reinforcing protrusions are intermittently formed.

17. The heat exchanger of claim 16, wherein the side face reinforcing projections are provided on the top surfaces of the first outer peripheral ribs on the first heat conduction plate and the second heat conduction plate;

when the first heat conduction plate and the second heat conduction plate are alternately laminated, top and side surfaces of the side face reinforcing projections on the first heat conduction plate are in contact with the bottom and side surfaces of the first outer peripheral ribs on the second heat conduction plate, respectively; and the top and side surfaces of the side face reinforcing projections on the second heat conduction plate are in contact with the bottom and side surfaces of the first outer peripheral ribs on the first heat conduction plate, respectively.

18. The heat exchanger of claim 16, wherein when the first heat conduction plate and second heat conduction plate are alternately laminated, the top and side surfaces of the first outer peripheral ribs on the first heat conduction plate are in contact with the bottom and side surfaces of the first outer peripheral ribs on the second heat conduction plates, respectively; and the top and side surfaces of the side face reinforcing projections formed on the first outer peripheral ribs on the second heat conduction plate are in contact with the bottom and side surfaces of the first outer peripheral ribs on the first heat conduction plate, respectively.

* * * * *